US005101532A

United States Patent [19]

Dyson et al.

[11] Patent Number: 5,101,532

[45] Date of Patent: Apr. 7, 1992

[54] POWDER DISPENSING AND CLEANING APPARATUS

[75] Inventors: James Dyson, Sycamore House, United Kingdom; Donald J. LaBute, Welland, Canada

[73] Assignee: Iona Applinaces Inc./Appareils Iona Inc., Welland, Canada

[21] Appl. No.: 291,344

[22] Filed: Dec. 29, 1988

Related U.S. Application Data

[63] Continuation-in-part of Ser. No. 188.545, Apr. 29, 1988, abandoned.

[30] Foreign Application Priority Data

Apr. 3, 1987 [CA] Canada ..... 536097

[51] Int. Cl.[5] ..... A47L 11/03

[52] U.S. Cl. ..... 15/320; 15/50.3; 15/328; 15/377; 222/199; 222/200

[58] Field of Search ..... 15/50 C, 320, 377, 328; 222/199, 200

[56] References Cited

U.S. PATENT DOCUMENTS

| | | | |
|---|---|---|---|
| 632,891 | 9/1899 | Burnett . | |
| 949,400 | 2/1910 | McFee . | |
| 1,059,427 | 4/1913 | Barnwell . | |
| 1,141,478 | 6/1915 | Mount . | |
| 1,715,058 | 5/1929 | Dornhecker . | |
| 1,751,001 | 3/1930 | Guth . | |
| 1,763,757 | 6/1930 | Charles . | |
| 2,071,373 | 2/1937 | Wurzbach et al. | 250/72 |
| 2,079,364 | 5/1937 | Stewart | 221/66 |
| 2,100,878 | 11/1937 | Shallock | 221/122 |
| 2,135,077 | 11/1938 | Hove | 275/2 |
| 2,248,725 | 7/1941 | Stelzer et al. | 131/21 |
| 2,307,291 | 1/1943 | Packwood, Jr. | 221/114 |
| 2,508,543 | 5/1950 | Sebok | 222/161 |
| 2,570,367 | 10/1951 | Mitten | 259/146 |
| 2,640,629 | 6/1953 | Thomson et al. | 222/161 |
| 2,685,986 | 8/1954 | Hamption | 222/200 |
| 2,692,142 | 10/1954 | Hunter | 275/2 |
| 2,783,698 | 3/1957 | Bambi | 97/10 |
| 2,788,725 | 4/1957 | Wilkey et al. | 97/10 |
| 2,796,202 | 6/1957 | Lawrence et al. | 222/233 |
| 2,801,773 | 8/1957 | Vitkin | 222/200 |
| 2,859,462 | 11/1958 | Shafer | 15/99 |
| 2,873,890 | 2/1959 | Starkenberg | 222/136 |
| 2,907,498 | 10/1959 | van der Lely et al. | 222/199 |
| 2,935,754 | 5/1960 | Abdo et al. | 55/124 |
| 2,976,112 | 3/1961 | Yonkers et al. | 8/150 |
| 3,028,053 | 4/1962 | Brown et al. | 222/161 |
| 3,050,215 | 8/1962 | Williams | 222/161 |
| 3,104,413 | 9/1963 | Nelson | 15/529 |

(List continued on next page.)

FOREIGN PATENT DOCUMENTS

| | | | |
|---|---|---|---|
| 18395 | of 1929 | Australia | 222/199 |
| 0157923A1 | 10/1985 | European Pat. Off. . | |
| 2718205 | 11/1978 | Fed. Rep. of Germany . | |
| 6616625 | 5/1967 | Netherlands . | |
| PCT/GB86/-00517 | 9/1986 | PCT Int'l Appl. . | |

*Primary Examiner*—Chris K. Moore

*Attorney, Agent, or Firm*—Rogers, Bereskin & Parr

[57] ABSTRACT

Method and apparatus for controlling dispensing of "dry" powdered compositions particularly carpet cleaning compositions wherein the confined finely divided particles descend in a stream under gravity and have oscillatory movement imparted thereto next before discharge through an orifice leading therefrom so as to agitate, separate and propel the particles therethrough; and in the case of carpet cleaning operations depositing the finely divided discharged particles onto the surface of the fibres in a substantially uniform pattern thereover followed by working same into the fibres through the application thereto of a rotary brush or beater and thereafter recovering the residues by a suitable suction or vacuum unit utilizing a rotary brush or beater and an associated two stage cyclone separator.

60 Claims, 11 Drawing Sheets

U.S. PATENT DOCUMENTS

| | | | |
|---|---|---|---|
| 3,127,631 | 4/1964 | Hershberger et al. | 15/588 |
| 3,173,165 | 3/1965 | Speight | 15/533 |
| 3,197,083 | 7/1965 | Elliott et al. | 222/231 |
| 3,203,599 | 8/1965 | Renner | 222/196 |
| 3,207,379 | 9/1965 | Waldrum | 222/177 |
| 3,268,121 | 8/1966 | Walker et al. | 222/177 |
| 3,270,366 | 9/1966 | Maichen | 15/559 |
| 3,289,240 | 12/1966 | Vanderveer et al. | 15/532 |
| 3,328,829 | 7/1967 | Nighswander | 15/533 |
| 3,432,075 | 3/1969 | Myers et al. | 221/178 |
| 3,451,595 | 6/1969 | Dexter | 222/177 |
| 3,472,431 | 10/1969 | Bodine | 222/146 |
| 3,526,344 | 9/1970 | Koning | 222/196 |
| 3,643,820 | 2/1972 | Hammond | 214/17 D |
| 3,659,753 | 5/1972 | Jäger | 222/199 |
| 3,700,142 | 10/1972 | Waibel | 222/109 |
| 3,747,811 | 7/1973 | Lewis et al. | 222/233 |
| 3,820,905 | 6/1974 | Sims | 401/140 |
| 3,982,671 | 9/1976 | Curl | 222/178 |
| 4,097,953 | 7/1978 | McKinney et al. | 15/320 |
| 4,105,143 | 8/1978 | Blinn | 222/161 |
| 4,185,932 | 1/1980 | Yonkers et al. | 401/21 |
| 4,188,907 | 2/1980 | Lipani | 118/657 |
| 4,240,569 | 12/1980 | Bessinger | 222/220 |
| 4,245,371 | 1/1981 | Satterfield | 15/328 X |
| 4,268,935 | 5/1981 | Bessinger | 15/320 |
| 4,314,515 | 2/1982 | Jimenez et al. | 111/77 |
| 4,359,175 | 11/1982 | Lizenby | 222/199 |
| 4,363,574 | 12/1982 | Bjurling | 406/114 |
| 4,378,871 | 4/1983 | Clark | 193/2 R |
| 4,381,157 | 4/1983 | Brown | 401/21 |
| 4,457,042 | 7/1984 | Jones et al. | 15/320 X |
| 4,512,057 | 4/1985 | Laing et al. | 15/320 |
| 4,549,328 | 10/1985 | Martin et al. | 15/328 X |
| 4,583,660 | 4/1986 | La Barre et al. | 222/1 |
| 4,619,276 | 10/1986 | Albertson et al. | 131/79 |
| 4,630,755 | 12/1986 | Campbell | 222/56 |
| 4,634,025 | 1/1987 | Swartling | 222/161 |

30
34

30
212
212
196
28
214
212
212
44
200
220
210
222
216
218
26

196
28
204
198
45
200
44
206
208
254
26
250
252

POWDER DISPENSING AND CLEANING APPARATUS

This is a continuation-in-part of application Ser. No. 07/188,545, filed on Apr. 29, 1988, now abandoned.

FIELD OF INVENTION

This invention relates to improvements in a method and apparatus for controlling dispensing of finely divided particulate compositions and especially to a method and apparatus for cleaning carpets, rugs or broadloom by the application thereto of a suitable "dry" finely divided particulate cleaning composition followed by the recovery therefrom of the residues and associated soil or contaminants and other debris lodged therein.

BACKGROUND TO THE INVENTION

"Dry" cleaning compositions for cleaning carpets, rugs or broadloom or the like have been developed and with the improvements of recent years have been shown in use to be particularly effective in removing soil and contaminants therefrom.

"Dry" indicates that the cleaning compositions can be handled in the form of a powder that will flow at room temperature although such compositions may contain a considerable amount of liquid such as water or organic solvents. Such "dry" cleaning compositions have a high soil or contaminant removal capacity so as to extract same over a relatively short interval of time.

"Dry" powdered cleaning compositions of the type to be employed in the improved method and apparatus of this invention may take the form of polyurethane, polystyrene and phenol-formaldehyde resin particles combined with water, an organic liquid, and a surfactant, as set forth in U.S. Pat. No. 2,015,972.

Another "dry" powdered cleaning composition likewise effective in removing soil or contaminants is derived from solid polymeric urea-formaldehyde particles from about 10 to 105 microns in size and a suitable solvent as described in U.S. Pat. No. 4,013,594.

Still another suitable composition is disclosed in U.S. Pat. No. 4,108,800 wherein polyethylene glycol is added to a semi-dry cleaning composition such as that set out in U.S. Pat. No. 4,013,594 to prevent adhering of the very fine particles of the composition to the fibres, which occur in part from the breakdown of the larger particles due to abrasion and thereby increase overall efficiency in the recovery of such residues by a suction-type cleaner.

"Dry" carpet cleaning compositions are expensive. Accordingly the effective and efficient application of same is desirable and may be a critical factor in some circumstances, considering the cost, as to whether such a treatment should be undertaken.

One early example of an applicator for such compositions is illustrated in U.S. Pat. No. 2,632,538 which includes a rotatable foraminous hollow cylinder adapted to be filled with a "dry" powdered cleaning composition which passes therethrough and to be distributed thereby over the surface of the fibrous floor covering when the cylinder is rotated.

Brushes carried by the frame of such unit are used to work the particles of cleaning composition into the fibres.

Other applicators that utilize similar structures are found in U.S. Pat. No. 3,289,240 and U.S. Pat. No. 4,381,156.

A more recent example of applicator, marketed under the trade mark KENMORE, includes a wheeled lower main body portion of an upright suction or vacuum cleaner provided forwardly with a hopper thereabove mounted to extend over the rotating brush or beater thereof.

Such hopper is provided with a pair of spaced apart discharge slots or orifices each having a fixed perimeter or cross-section positioned forwardly and lowermost, through which the dry powdered cleaning composition is adapted to be discharged in spaced apart streams under gravity aided by a selectively driven bladed dispensing roll mounted for rotation within the hopper so as to agitate the particulate material and direct the flow towards the discharge slots or orifices.

According to this arrangement the particles of cleaning composition are deposited somewhat unevenly and are adapted to be spread and worked into the fibres by manipulation of the appliance in which the rotary brush is driven in a direction reversely to the normal forward direction when the appliance is used for vacuuming.

Clogging of the spaced apart discharge orifices from the hopper of the aforementioned unit often occurs requiring the apparatus be shut down and the orifices cleared during the operation.

Subsequently after the elapse of an appropriate interval of time the appliance is converted to operate as a suction or vacuum cleaner with the drive to the brush or beater reversed to rotate in the forward direction to loosen the residues and other debris which are then taken up into the nozzle of the unit and carried to the collection chamber therein for later disposal in the well known manner.

No shut off or effective closure of the discharge orifices is included in the KENMORE unit so that all of the cleaning material is usually dispersed in the operation at hand or must be drawn into the suction recovery passageway where the apparatus is activated to operate as a vacuum cleaner.

Nor does there appear to be sufficient suction generated with such appliance to recover in a satisfactory way the very finely divided residues which when taken up in the dirty air stream tend to escape into the atmosphere through the mesh of the disposable bags or fabrics used to contain same, which fine particles collect on the surfaces of furniture and floor coverings in the surrounding area.

OBJECTS OF THE INVENTION

It is a principal object of this invention therefore to provide an improved method and apparatus for controlling the dispensing of "dry" powdered compositions such as cleaning compositions for carpets, rugs, broadloom from a confined body of same, and particularly to deliver only the requisite amount of material and in a more uniform pattern in the case of the discharge of same onto the surfaces of floor coverings, whereby the particles can be more effectively worked into the fibres to extract soil and contaminants therefrom and so minimize waste and effort and thereby increase the overall efficiency of such an operation at a reduction in the cost.

More particularly it is a very important object to provide an improved dispensing method for such particulate compositions and improved apparatus to implement same in which the likelihood of clogging of the discharge orifice is also minimized thereby promoting a more even flow of particles therethrough and in the case of carpet cleaning operations a more uniform application of the particles to the surfaces of the floor coverings to be treated.

Still another important object is to provide improved apparatus in which a minimum of operable components of relatively simple but sturdy construction are utilized for achieving a substantially uniform dispensing pattern of dry powdered composition, and which in the case of the application of such compositions to carpets, rugs, or broadloom, can be readily adapted for combined operation with suction or vacuum cleaners that include a rotating brush or beater within the nozzle whereby the deposited particles can be worked well into the fibres.

Another very important object is to provide a novel combination of improved dispensing apparatus and modified suction or vacuum unit utilizing a rotating brush or beater with an improved system for collecting the very finely divided residues whereby a greater proportion of such residues are recovered and retained therewithin for later disposal.

It is also an important object to provide an improved method and apparatus wherein not only unnecessary waste or loss of the expensive particulate cleaning composition is minimized but in which any unused portion can be safely preserved and stored after the treatment step is terminated and be immediately available and ready for dispensing when the ensuing treatment is undertaken.

Still another very important object is to provide such improved combination of dispensing apparatus associated suction or vacuum unit and improved collection system with an attractive high tech appearance of relatively light weight, ready manoeuvrability and operability so as to promote its general acceptance both for domestic and commercial use.

FEATURES OF THE INVENTION

The principal feature of this invention resides in controlling the dispensing of finely divided particles from a confined body of same through a discharge orifice leading therefrom by directing such body of particles in a stream towards such discharge orifice and imparting oscillatory movement to such stream next before discharge so as to agitate, separate and propel the foremost particles of the stream through the discharge orifice.

More particularly the stream of particles is adapted to be directed along a downwardly inclined pathway for the discharge of same through an orifice lowermost while such oscillatory movement is imparted to the descending stream of particles therealong and which oscillatory movement is of the greatest magnitude in the region thereof next before discharge.

Still more particularly according to the preferred method embodying the invention the finely divided particulate composition descends in a stream under gravity along a pathway of substantial width the lowermost portion thereof defining such pathway being displaceable such that oscillatory movement can be imparted to the stream of particles from below and with ever increasing amplitude until finally propelled through the discharge orifice in a wide thin substantially continuous uniform pattern.

It is a feature of this invention in implementing such preferred method to provide such discharge orifice to one side and lowermost of a hopper formation in which the particulate composition is to be confined in the receptacle portion thereof, which discharge orifice takes the form of spaced apart lips of a jaw-like structure, the upper jaw-like component being presented by the upstanding front or forward wall formation of the receptacle portion and includes a generally horizontally extending elongated edge formation or upper lip with a portion of the bottom wall constituting the lower jaw-like component likewise presenting a co-operating generally horizontally extending edge formation or lower lip and wherein the lower jaw-like component or bottom wall portion is supported for limited swinging displacement about an axis rearwardly of and remote from the lower lip, the upper surface of such bottom wall portion constituting a pathway portion leading to the discharge orifice whereby under reciprocation of same the opposed lips are repeatedly separated and oscillatory movement of increasing and sufficient amplitude imparted to reciprocate the particles thereabove throughout their advancement over the pathway portion next before discharge so as to agitate, separate and propel the particles through the gap defined by the spaced apart lips in a substantially continuous uniform pattern and at a substantially constant rate.

More particularly by providing the discharge orifice formation in the form of separable lips the optimum separation or gap for effectively passing a range of particle sizes of a preferred composition therebetween can be established through limiting the descent under reciprocation of the lower jaw-like component or pathway portion of the bottom wall formation. Such an arrangement provides greater control over the discharge of such fine particles.

Furthermore, since the discharge orifice is defined by opposing lips presented by adjacent front or bottom wall portions defining the hopper formation in the preferred apparatus the separation of the side and rear wall formations can be selected so as to match the longitudinal extent of the rotary brush or beater of an applicator or a suitable suction or vacuum unit upon which the hopper formation is to be mounted in the combinations of the preferred embodiment.

Accordingly, with such discharge orifice in combination with a rotary brush or beater the requisite amount of a selected cleaning composition can be laid down in a thin layer upon a floor covering surface next before the advance of such brush or beater in a width corresponding to the length of such brush or beater, thereby minimizing unevenness of deposition and the required manipulation of the appliance to effectively distribute and work the particles into the fibres.

Still more particularly it is a feature of this invention to mount the lower jaw-like component or bottom wall portion of the hopper formation at an inclination to the horizontal preferably of the order of 15 degrees so that the confined particles will be positively directed under gravity upon reciprocation, to descend in a stream towards the gap between the lips.

Another feature of this invention resides in utilizing in the preferred embodiment of the apparatus an eccentric cam driven at a selected angular velocity and associated depending cam follower carried by the lower jaw-like component of the discharge orifice to reciprocate same so as to impart periodic oscillatory movement to the stream of particles directed towards the discharge orifice and whereby through appropriate dimensioning and placement of the cam and cam follower the desired lip separation or gap can be established.

Further, it is a feature of this invention, when imparting periodic movement to the stream of particles to be discharged, to bias the lower jaw-like component of the discharge orifice against the eccentric cam thereby reducing disruptions in the reciprocable movement of same providing a more continuous periodic oscillatory movement to the stream of particles directed to the discharge orifice, and maintaining, for ready passage of such particles therethrough, the desired lip separation or gap established.

More particularly it is a feature to mount the eccentric cam upon the axle of the rotating brush or beater of an applicator or suitable suction or vacuum cleaner thereby and utilizing the drive from the main motor for rotating both the brush and for reciprocating the lower jaw-like component or bottom wall portion.

Still another feature resides in providing in combination with the novel dispensing apparatus and associated suction or vacuum unit as outlined above of a two stage cyclone separator embodying the features of U.S. Pat. Nos. 4,043,748, 4,377,882, 4,373,228, 4,571,772, 4,593,429 and U.S. Pat. No. 32,257, placed in communication with the discharge of the suction fan of the unit to receive and separate out the recovered residues in two stages, the second stage having the capability of removing a greater proportion of the very finely divided residues entrained in the dirty air stream before the air stream is discharged into the atmosphere and collecting and retaining same therein for ready later disposal.

Still another feature resides in providing in the preferred embodiment of the combined dispensing applicator or appliance including the driven rotary brush or beater, a switching device that includes a displaceable cam element mounted for rotation remotely controlled from the handle of the appliance through a tensioned cable connector for actuating an electrical switch to energize the motor and for positioning the displaceable lower jaw-like component or bottom wall portion of the discharge orifice while rotating the rotary brush or beater for achieving the following:

(i) delivering the particulate composition onto the floor covering surface and working same thereinto by the rotating brush or beater in the first mode; and where the applicator includes the suction or vacuum cleaner option, (ii) closing the discharge orifice and maintaining the brushing action and continuing to work the particles into the fibres in the second mode, (iii) maintaining the discharge orifice in the closed position while operating the appliance as a vacuum cleaner and utilizing the rotating brush or beater to recover the residues from the fibres and deliver same through the suction fan to the recovery stage preferably the two stage cyclone separator in the third mode, and (iv) maintaining the discharge orifice in the closed position upon shutting down the operation of the appliance.

Another feature of this invention resides in providing in the aforementioned preferred embodiment a swingable valve for closing the suction passageway extending between the aformentioned nozzle formation and the intake of the suction fan, and opening a bypass aperture or inlet thereinto for communication with the atmosphere, which valve position is controlled by the displacement of rotatable cam element of the switching device such that when the apparatus is to be operated in the dispensing and brushing mode such suction passageway is sealed by such valve against communication between the nozzle and the fan intake to prevent particles of dispensed cleaning composition from being drawn into the nozzle and suction fan and place the intake of the suction fan in communication with the atmosphere through the bypass aperture or inlet to relieve such valve against the suction forces generated by the fan; and when the appliance is programmed through the switching device remotely controlling the aformentioned rotatable cam element to implement the vacuum mode to take up the spent cleaning composition residues and the like, the valve is displaced in a direction so that communication between the nozzle and suction fan intake is restored and the bypass aperture or inlet sealed off.

These and other objects and features are to be found in the following description to be read in conjunction with the accompanying sheets of drawings in which.

Figure 1:
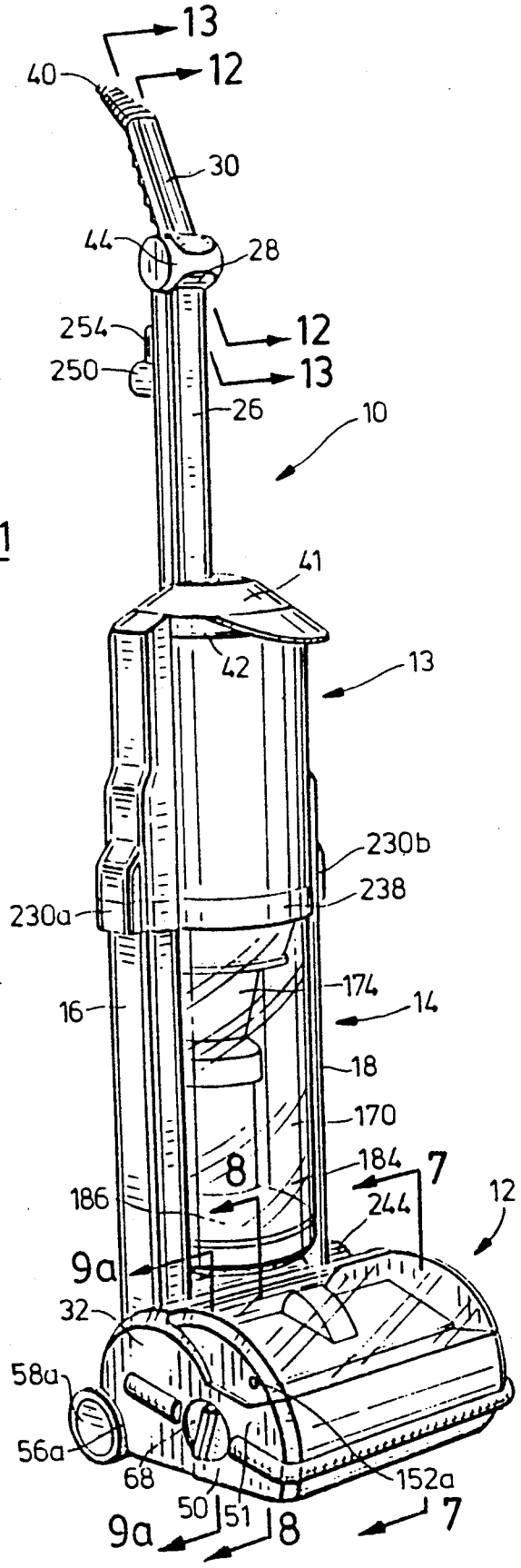
FIG. 1 is a perspective view taken from a point to the front and to the left side of a carpet cleaning apparatus or appliance embodying the invention disposed in the upright or inoperative position.
Figure 9A:
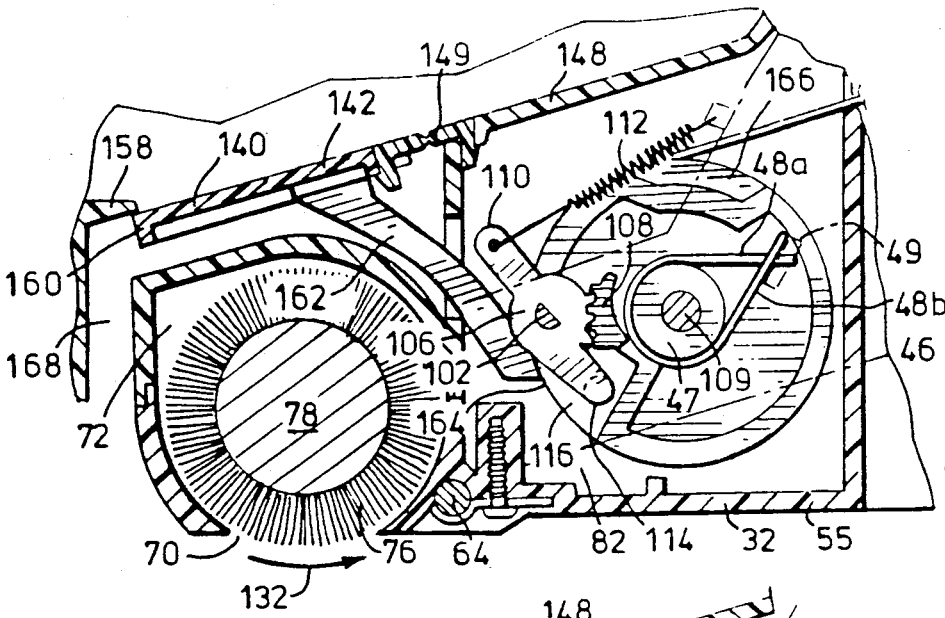
Figure 9B:
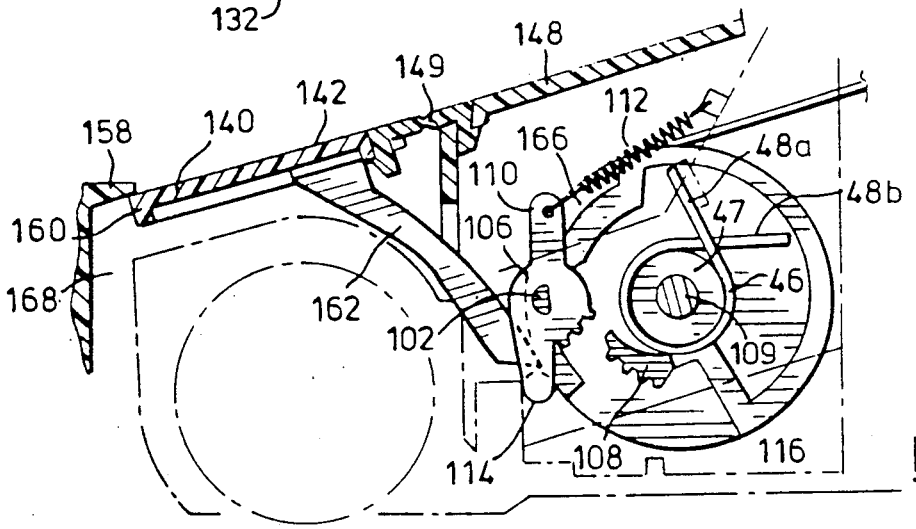
Figure 9C:
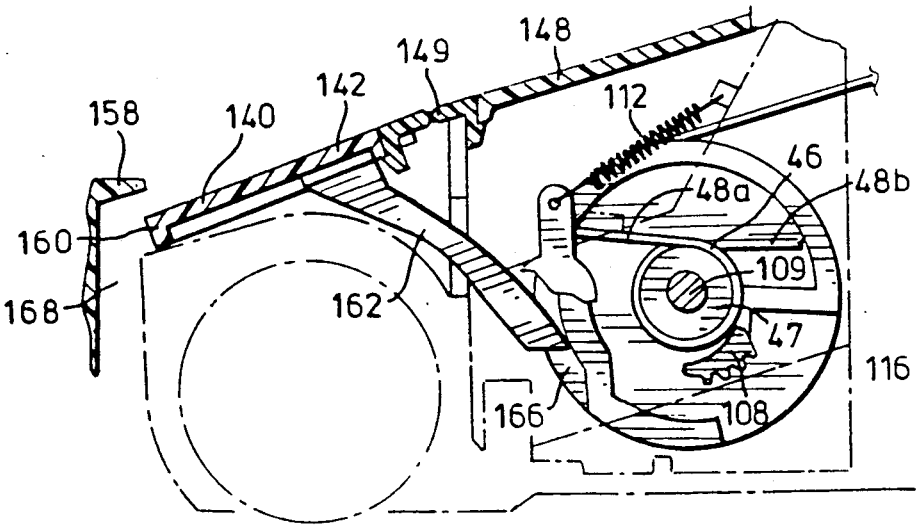
Figure 9D:
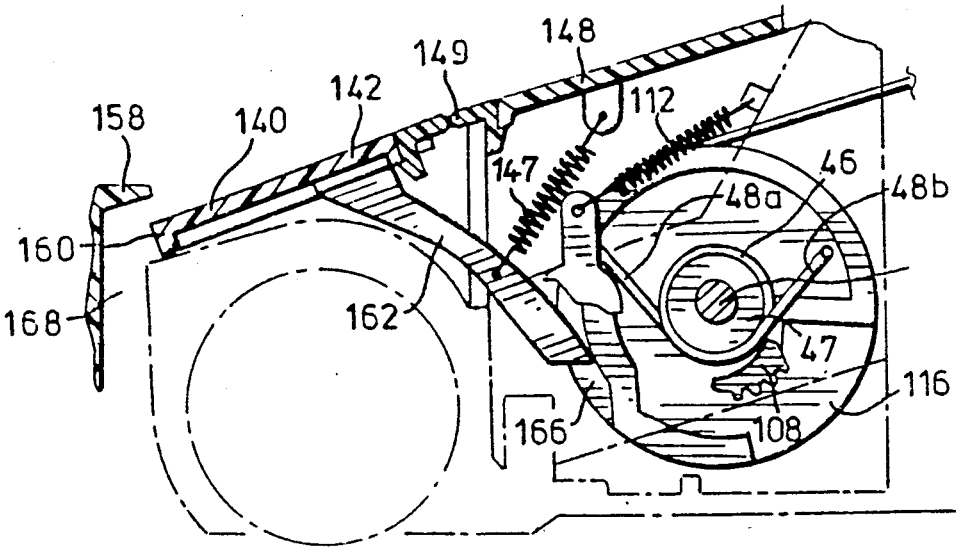
Figure 10:
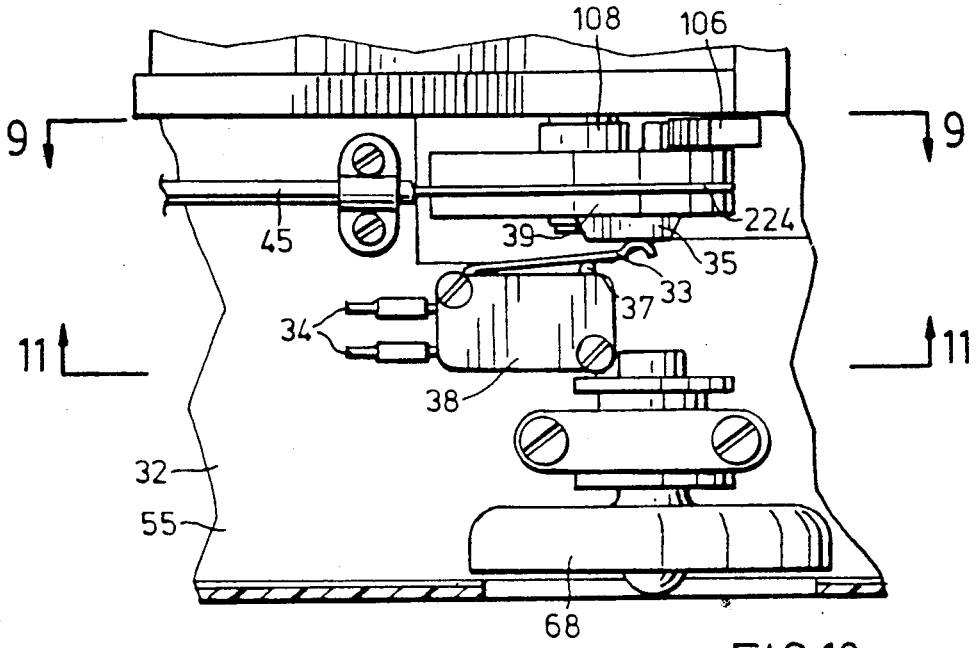
Figure 11:
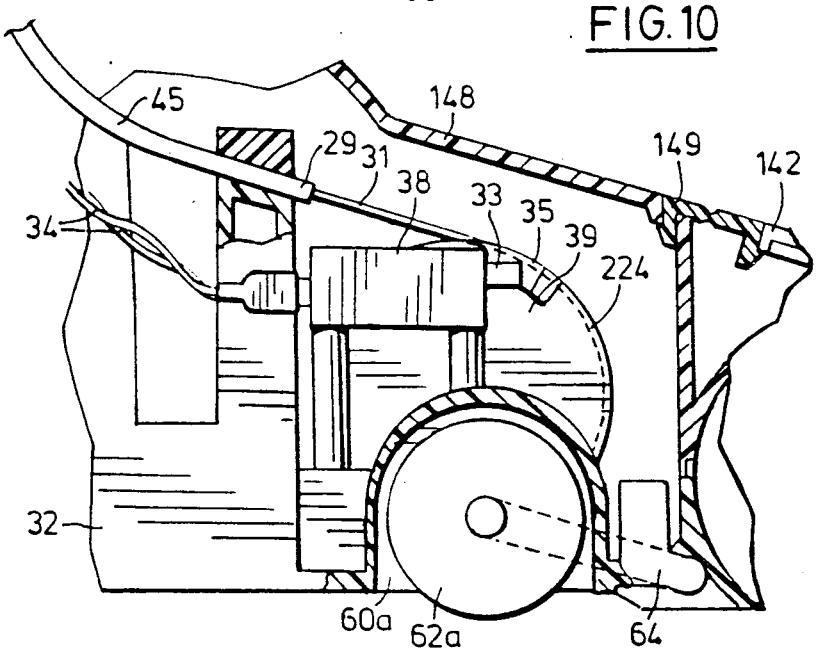
Figures 12, 13:
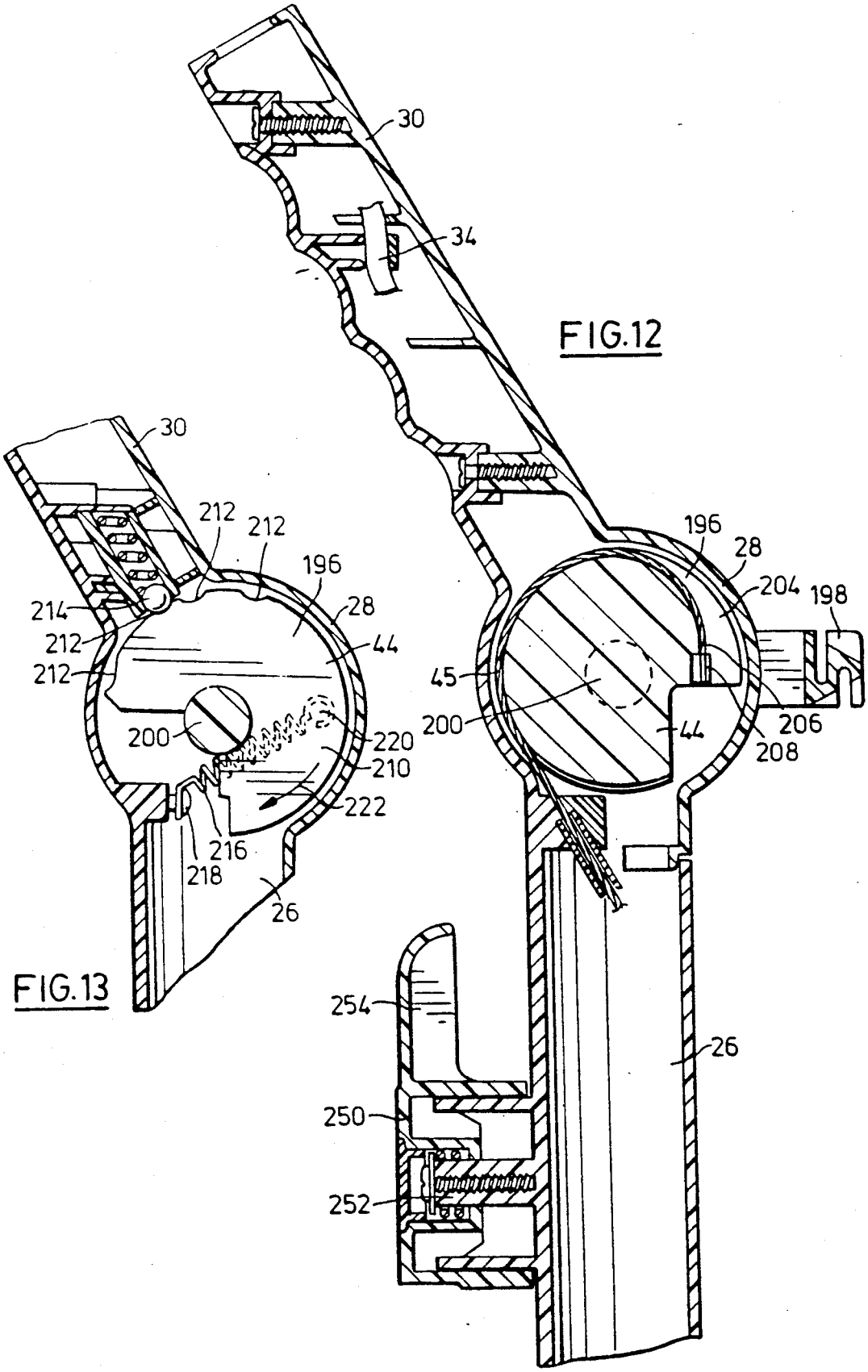

FIG. 9*a* is a still further side elevational view partly broken away of the main lower body portion taken along the line 9—9 of FIG. 10, focussing upon the structure of the cam for activating the remote switch mechanism and relationship of such cam to the other associated components when the carpet cleaning apparatus is in the vacuuming mode;

FIG. 9*b* is a side elevational view partly broken away corresponding to FIG. 9*a* illustrating the structure of the cam and its relationship to the other associated components when the carpet cleaning apparatus is in the brush only mode;

FIG. 9*c* is again a side elevational view partly broken away corresponding to FIG. 9*a* illustrating the structure of the cam and its relationship to the other associated components when the carpet cleaning apparatus is in the dispensing and brush mode;

FIG. 9*d* is a view similar to FIG. 9*c* but illustrating the means for biasing the lower jaw-like component of the discharge orifice;

FIG. 10 is a plan view partly broken away of that part of the main lower body portion illustrated in FIG. 9;

FIG. 11 is a further side elevational view partly broken away of that part of the main lower body portion illustrated in FIG. 10 taken from the left side of the apparatus along the line 11—11;

FIG. 12 is a vertical cross sectional view, partly broken away of the handle extension of the apparatus of FIG. 1 together with the upright hollow column supporting same for indexed movement taken along the line 12—12 of FIG. 1;

FIG. 13 is a vertical cross sectional view corresponding to FIG. 12, but from the side of the apparatus opposite to that illustrated in FIG. 12 taken along line 13—13 of FIG. 1

DESCRIPTION OF THE INVENTION

Apparatus in the form of appliance 10 suitable for carpet cleaning operations or the like embodying the invention is depicted in FIGS. 1 to 13 inclusive of the drawings hereof.

Appliance 10 is comprised of a wheeled main lower body or base portion 12 and a swingable upright handle formation 13 that includes an elongated generally cylindrically-shaped cyclone-type separator 14 upstanding centrally rearwardly of main lower body portion or base 12 supported thereabove between a pair of upstanding aligned oppositely disposed extensible hollow support column formations 18 connected lowermost to main body portion 12 through respective spaced apart hollow-pivot formations 20, 22.

Hollow-pivot formations 20, 22 have a common transversely extending axis 24 with associated hollow column formations 16, 18 and cyclone separator 14 carried and supported therebetween together presenting a rearwardly upstanding centrally located hollow shaft-like control member 26 thereabove which control member 26 terminates uppermost in a hollow pivotal connector or knuckle 28 from which a hollow hand-gripping extension 30 rearwardly projects.

The aforementioned hollow structures provide an internal or protected passageway from the outer end of hollow hand-gripping extension 30 to within the interior of housing 32 of the main lower body portion 12 for enclosing electrical cable 34 for energizing electric motor 36 through displacement of contact 37 of remotely controlled electric switch 38 as follows:

Electrical cable 34 extends from plug 40 to the outer end of hollow hand-gripping extension 30 and therealong internally thereof through hollow knuckle 28 down centrally located hollow shaft-like control member 26 and under truncated conically shaped cap formation 41, mounted in overlying spaced relation above the discharge outlet 42 for cyclone separator 14 and secured thereto, which cap formation 41 diverts, when operating, the airstream expelled therefrom, then down through extensible hollow support column 16 and through lower hollow pivot formation 20 into the interior of housing 32 to connect with remotely controlled electric switch 38.

As best illustrated in FIG. 10 electric switch 38 includes a cam follower 33 and a displaceable contact 37. Cam follower 33 is adapted to follow the contoured side surface 35 of rotatable cam element 39 so as to depress or release displaceable contact 37, depending upon the direction and extent of rotation of cam element 39.

Displacement of rotatable cam element 39 is controlled by a switching device 44 mounted for indexed rotation within hollow connector or knuckle 28 of handle formation 13 from which hollow hand gripping extension 30 projects through a tensioned control cable 45 secured therebetween which will be described in more detail in paragraphs to follow.

Control cable 45 is adapted to be maintained in its tensioned state by means of a helically wound mechanical spring element 46 carried by hub portion 47 of displaceable cam element 39 in the manner illustrated in FIG. 9*a* with one arm 48*a* of element 46 bearing against a support projection 49 presented by the housing 32 and with the other arm 48*b* anchored in cam element 39 so as to urge cam element 39 in a direction to tension control cable 45.

Control cable 45 in a similiar manner to electrical cable 34 extends from switching device 44 down centrally located hollow shaft-like control member 26 and under truncated conically shaped cap formation 41, then down through extensible hollow support column 16 and through lower hollow pivot formation 20 into the interior of housing 32 to connect with the rotary cam element 39. In order to insure that tensioned control cable 45 slides freely in those regions where it changes direction along its path when switching device 44 is appropriated to rotate displaceable cam element 39, control cable 45 is provided with sleeved portions 29 in those regions, as best illustrated in FIGS. 10, 11, and 12.

Housing 32 of main body portion 12 which is illustrated in detail in FIGS. 4, 5 and 7 to 11 inclusive is comprised of a lower section or support base member 50 and separable upper section or overlying enclosure 51 with both sections 50, 51 preferably molded from a suitable strong resilient plastic.

Lower support base member 50 is shaped to present requisite upstanding perimetral, side, forward and rearward support portions 52*a*, 52*b*, 53 and 54 separated by a central connecting web portion 55 presenting requisite recesses and support projections for locating the required components to be mounted thereon or therewithin and for securing same thereto.

Part cylindrical recesses 56*a*, 56*b* presented by side and rear support portions 52*a*, 52*b* and 54 each opening to the rear and outwardly to the opposed sides of lower support base member 50 have aligned rear supporting wheels 58*a*, 58*b* of a substantial radius mounted therein for rotation. Lower support base member 50 on the underside presents inwardly disposed centrally located spaced apart part cylindrical recesses 60*a*, 60*b* wherein suitable wheels 62*a*, 62*b* of lesser radius as compared with rear supporting wheels 58*a*, 58*b* are mounted for rotation upon a shiftable axle 64, to give requisite support to the appliance 10 to promote maneuvrability of same over the carpet surfaces to be treated.

Axle 64 carrying wheels 62*a*, 62*b*, in order to shift, is supported for swinging movement within spaced-apart retaining elements 66*a*, 66*b* secured to the underside of central web portion 55. A helically wound spring (not illustrated) normally urges the axle 64 towards a retracted position of the wheels 62*a*, 62*b*. An indexed rotary control member 68 including graded tooth elements 69, is mounted for rotation within the side portion 52*a* of base member 50 and engages one end of axle 64 between successive graded tooth elements 69 to swing the axle 64 through an arc against the action of the spring 67 out of the retracted position and so selectively set and fix the downward descent of same.

Figure 4:
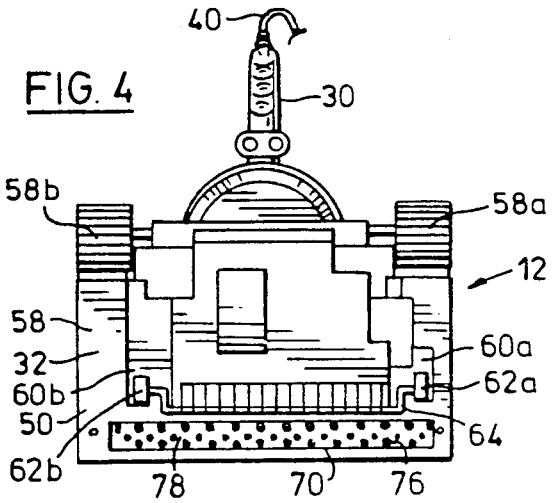
FIG. 4 is a bottom plan view of the main lower body portion of the apparatus of FIGS. 1 to 3.
Figure 5:
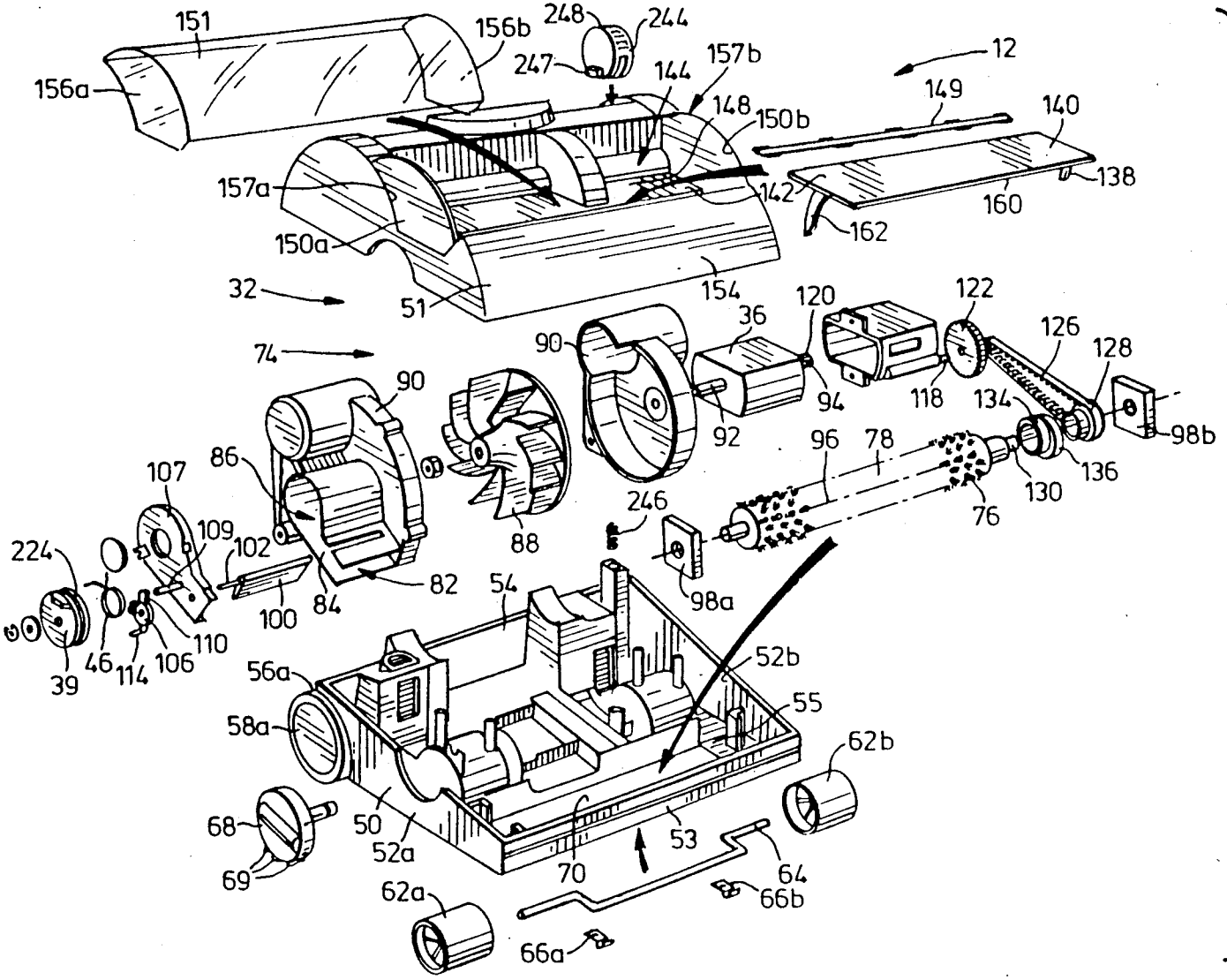
FIG. 5 is an exploded view in perspective of those components constituting the main lower body portion of the apparatus of FIGS. 1 to 4 inclusive.

Lower support base member 50 as best illustrated in FIGS. 4 and 5 also includes an elongated transversely extending aperture inlet 70 foremost and in advance of central supporting wheels 62*a* or 62*b* to define the inlet for nozzle 72 of the suction fan 74 for the appliance 10 which nozzle 72 has a generally hollow cyclindrically shaped configuration interiorly so as to embrace rotary brush or beater 78 and through which inlet 70 thereof the bristles 76 of a rotary brush or beater 78 are adapted to project.

Nozzle 72 is defined by the mating of lower support base member 50 with overlying enclosure 51.

Nozzle 72 communicates through an internal passageway 82 presented by a rearwardly and upwardly extending conduit section 84 with the intake 86 of suction fan 74.

Impeller 88 of suction fan 74 is mounted within the fan housing 90 upon suitable spaced apart projections so that impeller shaft 92 thereof extends transversely and in alignment with motor shaft 94 of electric motor 36, which shafts are coupled together to drive impeller 88 directly from electric motor 36.

Cylindrically-shaped brush or beater element 78 is mounted for rotation about its longitudinal axle 96 within transversely extending hollow nozzle formation 72 upon suitable bearing elements 98*a*, 98*b* which are releasably anchored within upstanding side support portions 52*a*, 52*b* of lower support base member 50 in a suitable manner with the axis of rotation arranged to extend in parallel relation to the axis of motor shaft 94.

The internal configurations of nozzle 72, the diameter of rotary brush or beater 78, and extent of bristles 76 thereof are all selected so that bristles 76 project sufficiently below main body portion 12 through inlet 70 so as to effectively penetrate and separate the fibres of the carpet to be treated when appliance 10 is programmed to discharge "dry" powdered cleaning compositions and brush same into the fibres, for the brushing mode so as to continue the working of the powdered cleaning compositions into the carpet, and for the vacuum mode to take up the dry powdered cleaning composition residues, associated soil and other debris therefrom.

The penetration of the bristles 76 can be adjusted for different carpets by displacing the indexed rotary control member 68 to lower or retract the centrally mounted wheels 62*a*,62*b*.

Passageway 82 connecting nozzle 72 to the fan intake 86 has a generally rectilinear configuration in cross section in the preferred embodiment, wherein a displaceable closure or valve plate 100 is swingably mounted so to close and seal same when the apparatus is programmed for or switched to the dispensing mode to reapply the selected particulate cleaning composition and brush same thereinto.

Figure 8:
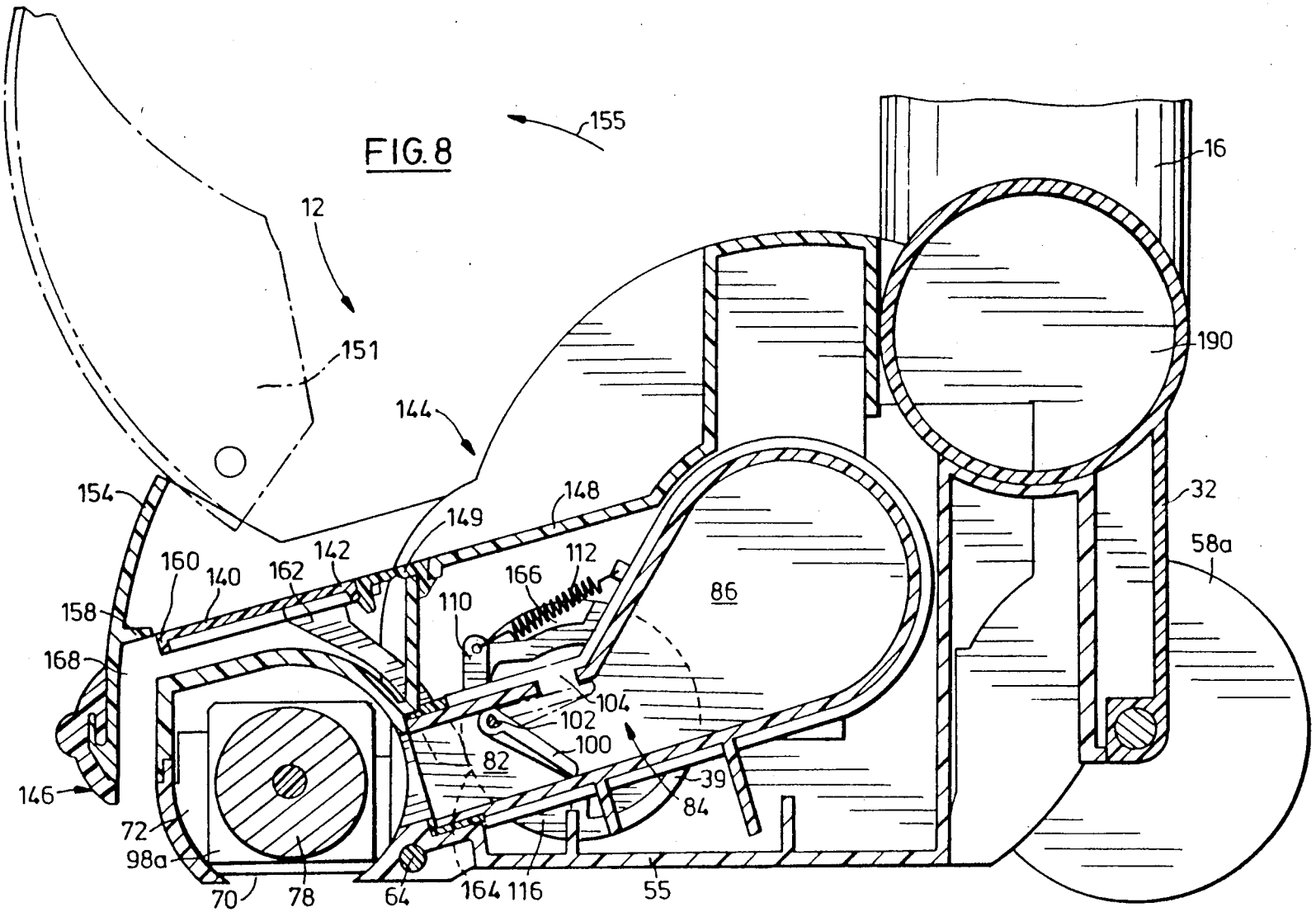
FIG. 8 is a further side elevational view partly broken away in partial cross-section of the main lower body portion taken from the right side of the apparatus illustrated in FIG. 1 along the line 8—8.

Valve plate 100 has an outline corresponding to the generally rectilinear configuration of the cross section of passageway 82 and is supported therein upon a pivot formation 102 extending transversely of passageway 82 to swing from the position shown in solid outline illustrated in FIG. 8 wherein passageway 82 is sealed off to the position shown in broken outline wherein passageway 82 is fully opened and the nozzle 72 placed in communication with the fan intake 86.

According to this arrangement the airstream generated by the operation of the impeller 88 of suction fan 74 can only pass through nozzle 72 and connecting passageway 82 to fan intake 86 when apparatus 10 is programmed for or switched to the vacuum mode to take up and recover the dry powdered cleaning composition residues and associated soil from the carpet. Otherwise the fan intake 86 is isolated from the nozzle 72 by valve plate 100.

More particularly, since the suction fan 74 continues to operate, passageway 82 is provided in the region above and rearwardly of pivot formation 102 with a bypass aperture 104 communicating with the atmosphere whereby atmospheric air can enter passageway 82 while valve plate 100 seals off nozzle 72 and be drawn into fan intake 86, which arrangement effectively preserves the seating of valve plate 100 to isolate the nozzle 72 and prevents any particles of cleaning composition from being drawn into the suction fan 74 while appliance 10 is operated in the dispensing and brushing mode or the brushing mode.

The position of valve plate 100 is controlled by a pair of sector gears 106, 108 located exteriorily of passageway 82.

Sector gear 106 fixedly secured to one end of pivot formation 102 is adapted to be displaced by sector gear 108 which is located on the inner surface of rotating cam element 39 and is likewise mounted upon pivot formation 109 presented by the end cover plate 107 of fan housing 90 for limited swinging movement.

Sector gear 106 presents an integral offset arm portion 110 for engagement with a mechanical spring element 112 fixedly anchored to housing 32 and arranged so as to normally urge sector gear 106 in a direction to displace swing valve plate 100 into the position shown in solid outline in FIG. 8 to completely and sealingly close passageway 82.

Sector gear 106 is also provided with a cam follower 114 projecting in a transverse direction to register within a contoured recess 116 presented by rotary cam element 39.

Upon rotation imparted to cam element 39 by tensioned control cable 45 from switching device 44 to implement the vacuum mode of operation sector gear 108 rotates sector gear 106 about pivot formation 102 through cam follower 114 against the tension of spring element 112 so as to swing sector gear 106 and associated valve plate 100 in a direction to close bypass aperture 104, shown in broken outline in FIG. 8, and so retain same in such position to establish communication between the nozzle 72 and the fan intake 86 while operating in the vacuum mode.

Motor shaft 94 at the end thereof remote from the coupling to suction fan 74 is provided with a pinion gear 120 which in turn drives gear wheel 122 mounted for rotation upon suitable support projection 118.

Gear wheel 122 through associated pinion gear 124 and toothed endless drive belt 126 engaging peripheral pinion gear 128 mounted at one end of the axle 130 of rotary brush beater 78 rotates same in the direction of the arrows 132.

Such gear train preferably has a ratio of the order of 10 to 1 so that with motor shaft 94 and associated pinion gear 120 operating at 20,000 rpm, rotary brush or beater 78 will be driven at 2,000 rpm.

Figure 7:
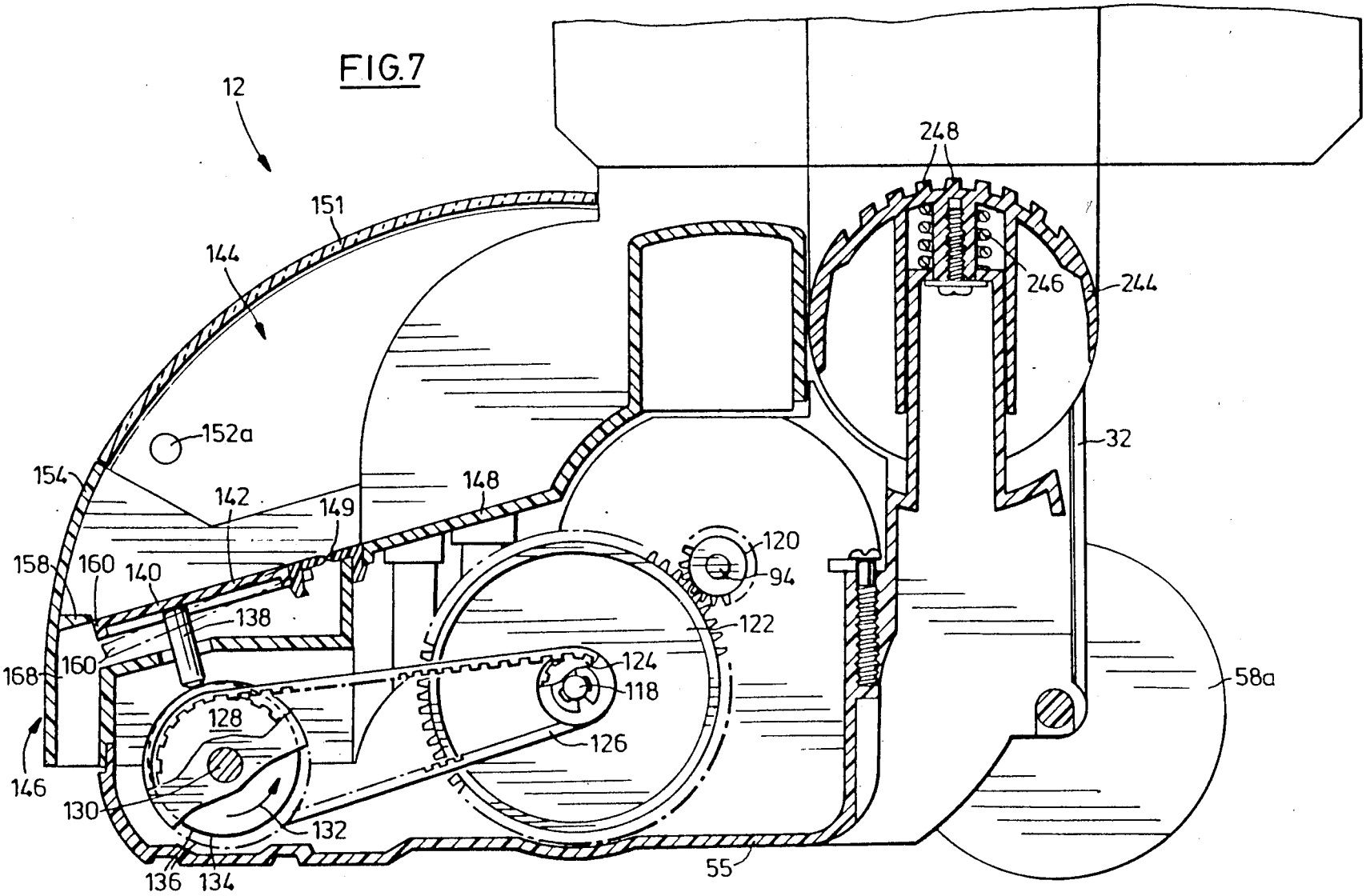
FIG. 7 is a side elevational view partly broken away and in partial cross-section of the main lower body portion taken from the right side of the apparatus illustrated in FIG. 1 along the line 7—7 thereof.

Coaxially mounted upon axle 130 of rotary brush or beater 78 at the end thereof next adjacent pinion gear 128 is a cam element 134 shown in FIG. 7 in broken and solid outline, whose perimetral eccentric edge formation 136 is adapted to engage a depending cam follower 138 carried by an overlying plate-like element 140 constituting the forward lower portion of a bottom wall formation 142 of a transversely extending receptacle or repository portion of a hopper formation 144 presented by the upper section 51.

Hopper formation 144 extends transversely to overlie the nozzle 72 and rearwardly upwardly therefrom wherein dry particulate carpet cleaning compositions are adapted to be deposited, confined and then to be dispensed through an elongated narrow discharge orifice formation 146 presented by such hopper formation 144 foremost lowermost and to one side thereof above nozzle 72.

Forwardly disposed bottom wall portion 142 and rearwardly disposed bottom wall portion 148 are interconnected by a hinge formation 149 on an axis parallel with the axis of axle 96 of rotary brush or beater 78 and have an angle of inclination of the order of 15 degrees so as to ensure the descent under gravity towards the discharge orifice formation 146 of the particulate cleaning compositions.

Upstanding side wall portions 150*a*, 150*b* of the receptacle or repository of hopper formation 144 are preferably sector shaped in the preferred embodiment. A displaceable cover 151, preferably transparent, overlies bottom wall portions 142 and 148 and has an arcuate configuration matching the curvature of the upper edges of sector shaped side wall portions 150*a*, 150*b*.

Displaceable cover 151 is mounted to swing about pivots 152*a*, 152*b* located above and rearwardly of forward upstanding wall portion 154 of hopper formation 144 from a position closing the hopper 144 as illustrated in FIG. 7 forwardly and upwardly in the direction of the arrows 155 to an upstanding or open position as shown in FIG. 8 for loading the hopper 144 with the powdered cleaning composition.

The transparent cover 151 is provided with depending side wall portions 156*a* and 156*b* which are adapted to extend outwardly of and below opposed sector shaped side wall portions 150*a*, 150*b* and shaped so as to register within matching recesses 157*a* and 157*b* presented outwardly thereof so as to closely confine the "dry" particulate carpet cleaning composition therewithin.

Forward upstanding wall portion 154 of hopper formation 144 is adapted to present a narrow transversely extending edge formation or lip 158 rearwardly centrally thereof as seen in FIGS. 7 and 8 and in parallel relation to the respective foremost edge formation or lower lip 160 of bottom wall portion 142 and axis of hinge formation 149 so as to engage with such edge formation or lip 160 and in such sealing position prevent the contents of the receptacle or repository portion of hopper formation 144 from escaping therebetween.

Swingable plate-like element 140 of bottom wall portion 142 is adapted to be supported with lower lip 160 in sealing engagement against upper lip 158 by means of a second depending cam follower 162 engaging rotary cam element 39 as shown in FIG. 8.

Depending cam follower 162 is located at the end of bottom wall portion 142 opposed to that shown in FIG. 7 and offset forwardly of the axis of hinge formation 149 and is so shaped and dimensioned as to only engage against arcuate edge portion 164 presented by rotary cam element 39 in the setting for operation of the appliance 10 in the brushing or vacuum mode, or when the appliance is shut down.

With cam follower 162 engaging arcuate portion 164 of rotary cam element 39 the lower lip 160 of bottom wall portion 142 is displaced upwardly into sealing engagement with upper lip 158.

The extent and configuration of arcuate portion 164 is selected such that upon further partial rotary displacement of cam element 39 in a direction to implement the dispensing and brushing mode cam follower 162 descends into a recess portion 166 whereupon plate like element 140 is released to swing downwardly to occupy the lower position shown in broken outline in FIG. 7 with the lips 158, 160 separated.

Thus can the discharge orifice formation 146 defined by the elongated transversely extending narrow edge formation or upper lip 158 projecting inwardly intermediately rearwardly from forward upstanding wall portion 154, the upper "jaw", and cooperating elongated lower edge formation or lower lip 160 presented by the displaceable lower bottom wall portion 140, the lower "jaw", be perceived as jaw-like.

It will be appreciated that with lower edge formation or lip 160 separated from upper edge formation or lip 158 a uniform gap therebetween is established which extends in generally parallel relation over the brush or beater 78 and forwardly of the nozzle 72 and has a selected transverse extent matching that of inlet 70 of nozzle 72 and of the projecting bristles 76 of rotary brush or beater 78.

Thus released and separated from upper lip 158, plate-like element 140 of bottom wall portion 142, as revealed in broken outline in FIG. 7, is supported about the horizontal axis of hinge formation 149 for swinging movement upwardly through a small acute angle, the mean setting for the separation of the lips 158, 160 being determined by the offset placement to hinge formation 149 and extent thereof respectively of the first mentioned depending cam follower 138 which engages and is in alignment with eccentric edge formation 136 presented by rotary cam element 134 which act to periodically displace plate-like element 140 upwardly to impart receiprocatory movement thereto in the dispensing and brushing mode.

A gap between the lips 158, 160 of the order of 4 mm constitutes an effective discharge passageway for the particle sizes of the available carpet cleaning compositions to be dispensed from hopper formation 144 thereby ensuring an improved substantially continuous metered flow therethrough and a more efficient laying down of the appropriate quantity of particulate cleaning composition and in a substantially uniform thin pattern transversely of the path taken by the appliance.

The rearwardly projecting edge formation or upper lip 158 presented by forward upstanding wall portion 154 and the foremost edge formation or lip 160 of plate-like element 140 of bottom wall portion 142 can be angled or chamfered, respectively or may overlap so that in the sealing disposition the lips 158, 160 can bear directly against one another and so prevent the escape of the small particles from the hopper formation 144 under vibrations imparted during the brushing or vacuum modes or when transported.

When plate-like element 140 of bottom wall portion 142 is released upon displacement of rotary cam element 39 to implement the dispensing and brushing mode of appliance 10 the electric motor 36 is simultaneously energized through electric switch 38 which imparts rotation to the rotary brush or beater 78 and coaxially mounted cam element 134 through gear train 120, 122, 124, drive belt 126 and pinion gear 128.

Plate-like element 140 of bottom wall portion 142 in that mode so supported from hinge formation 149 swings downwardly and presents cam follower 138 to bear upon eccentric peripheral surface 136 of cam element 134 as it is rotated, which peripheral surface is suitably contoured so as to periodically swing plate-like element 140 of bottom wall portion 142 upwardly and release same to descend under gravity so as to impart thereto "oscillatory movement" having a frequency, in the preferred embodiment, of the order of 2,000 cpm.

It can be appreciated that upon imparting such "oscillatory movement" having a frequency of the order of 2,000 cpm to plate-like element 140 of bottom wall portion 142 there is insufficient time for plate-like element 140 to descend under gravity so that cam follower 138 continually bears against eccentric peripheral surface 136 of cam element 134. Further, at such frequencies contoured surface 136 of cam element 134 could impart enough upward velocity to plate-like element 140 so as to momentarily close the gap established between lips 158, 160 preventing the discharge of the particles through the discharge orifice. These disruptions to the "oscillatory movement" of plate-like element 140 hinder the discharge of the particles through the discharge orifice. By providing a suitable biasing means such as spring 147, as illustrated in FIG. 9*d*, cam follower 138 of plate-like element 140 continually bears against the eccentric peripheral surface 136 of cam element 134 as it is rotated.

In the embodiment illustrated in FIG. 9*d* spring 147 is secured at one end to cam follower 162 and at its other end to bottom wall portion 148. Upon partial rotary displacement of cam element 39 in a direction to implement the dispensing and brushing mode cam follower 162 descends into recess portion 166 through both the action of gravity and the pull of spring 147, releasing plate-like element 140 to swing downwardly with the lips 158, 160 separted. With plate-like element 140 so biased depending cam follower 138 continually engages eccentric edge formation 136 presented by rotary cam element 134 when same is rotated ensuring continuous feed of particles through the gap established between lips 158, 160.

Those particles traversing the upper surface sequentially repeatedly descending under gravity and displaced upwardly by plate-like element 140 are agitated within the confined body of same and cause the particles to abrade and separate with the forces of gravity and those imparted by upward displacement propelling same in a direction towards the discharge orifice and through the gap established between lips 158, 160.

It will also be appreciated that the amplitude of the oscillatory movement imparted by the plate-like element 140 of the bottom wall portion 142 to those particles traversing the upper surface thereof increases as the particles approach the region next before discharge so that the combined forces applied to discharge the particles through the gap between lips 158, 160 are maximized at that stage.

Such forces imparted to the advancing particles of the confined composition throughout the extent of plate-like element 140 of bottom wall portion 142 serve to deliver same continuously towards and through the full extent of the gap between lips 158, 160 for deposit onto the carpet surface therebelow through discharge passageway 168 located immediately ahead of the advancing rotary brush element or beater 78.

Further, it is found in the preferred embodiment that bottom wall portion 142 be angled to the horizontal substantially to facilitate the approach of the particles to the discharge passageway 168 as same descend under gravity and have imparted thereto "oscillatory movement" by the plate-like element 140.

Cyclone-type separator 14 embodies the essential structure of the two stage cyclone apparatus illustrated and described in copending Canadian patent application serial numbers 628346, 458362 and 458360 and revealed also by issued U.S. Pat. Nos. 4,377,882, reissue 32,257, 4,373,228, 4,571,772, 4,593,429 and 4,043,748.

Cyclone separator 14 is comprised of an outer cyclone 170 presenting an inner wall 172 of generally cylindrical configuration and an inner cyclone 174 presenting an inner wall 176 of generally truncated conical configuration. An appropriate scroll-shaped first dirty air inlet (not illustrated) leads into the first stage and an appropriate second scroll-shaped dirty air inlet (not illustrated) leads from the outer cyclone 170 into the inner cyclone 174 which inner cyclone terminates in centrally located clean air outlet 42 uppermost for discharge of the clean airstream to the atmosphere.

The respective outer and inner collection receptacle portions 184, 186 of the cyclones 170 and 174 are disposed lowermost one within the other.

According to this aspect of the invention, with appliance 10 programmed to operate in the vacuum or take-up mode, valve plate 100 and bottom wall portion 142 are respectively displaced by rotary cam element 39 through tensioned control cable 45 and associated switching device 44 to open passageway 82 extending between nozzle 72 and the suction fan intake 86 and close bypass aperture 104 and seal the gap between lips 158 and 160 of the discharge orifice formation 146.

Simultaneously electric motor 36 is energized through the contact 37 electric switch 38 to rotate the brush or beater 78 and impeller 88 of suction fan 74.

The rotary brush or beater 78 of the appliance 10 in such mode is used to sweep the spent cleaning composition residues and associated carpet soil and contaminants out of the carpet fibres and under suction generated by the fan 74 are drawn into inlet 70 of nozzle 72 for entrainment in the airstream so generated and delivered through connecting passageway 82 to the fan intake 86.

The dirty airstream drawn into the fan intake 86 is then delivered by impeller 88 into passageway 190 extending within hollow pivot formation 22 mounted upon the main lower body portion 12 through the hollow interior 195 of upstanding hollow support column 18.

Internal passageway 195 at the upper end communicates with the scroll shaped inlet of the outer cyclone of cyclone separator 14 delivering the dirty airstream thereinto where, in such first stage, the airstream is stripped of the larger entrained particles and debris which descends into the collection receptacle portion 184 lowermost thereof.

The stripped dirty airstream is then discharged through the outlet of the outer cyclone 170 into the scroll shaped inlet of inner cyclone 174 wherein the finer particles entrained therein are substantially completely stripped therefrom and descend to the lowermost receptacle portion 186 thereof.

The resultant clean airstream substantially stripped of entrained particles is then directed upwardly centrally of the inner cyclone 174 and discharged through outlet 42 under cap formation 41 spaced thereabove and diverted radially thereby to the atmosphere.

The switching device 44 for controlling the displacement of rotary cam element 39 so as to implement the several modes of operation of appliance 10 is illustrated in detail in FIGS. 12 and 13 of the drawings.

Switching device 44 includes a displaceable indexed rotary control element 196 presenting a transversely extending upstanding bar portion 198 joining a pair of spaced apart disc-shaped elements 199*a*, 199*b* between which centrally located axle 200 extend; which axle is mounted for rotation within requisitely shaped opposed recesses of the knuckle housing of knuckle 28.

Mounted upon axle 200 within knuckle housing 28 intermediately between disc-shaped elements 199*a*, 199*b* is a pulley formation 204 presenting a grooved perimeter 206 in which the upper end of cable portion 31 of control cable 45 is received so as to extend therearound and be securely anchored against separation therefrom by means of a suitable tubular metal element 208 swaged onto the end thereof and wedged within the grooved perimeter 206 as illustrated in FIG. 12.

Mounted upon axle 200 for displacement therewith and in spaced relation alongside pulley formation 204 is a second disc-like member 210 whose perimeter is contoured to present several indents or recesses 212 circumferentially spaced so as to correspond with the requisite disposition of remote rotary cam element 39 to which displacement is to be imparted through tensioned control cable 45 upon displacement of control element 196 to implement the several modes or stages of operation of appliance 10 earlier described.

The several settings of control element 196 within the knuckle housing 28 are established by means of a spring urged ball bearing 214 presented by the hollow hand gripping extension 30 to the periphery of disc-like member 210 to register within the respective selected indents or recess 212 signifying the mode.

A spring 216 is mounted to extend between an abutment 218 presented by the interior of knuckle housing 28 and a fixed projection 220 presented by disc-like member 210 offset from axle 200 urges control element 196 in a direction indicated by arrow 222 so as to tension control cable 45.

Rotatable cam element 39, like pulley formation 204 presents grooved perimeter 224 in which the other end of cable portion 31 of control cable 45 is received to extend therearound and be securely anchored thereto against separation by a similar tubular element (not illustrated) swaged onto the end thereof and wedged within the grooved perimeter 224.

Thus can rotary displacement of indexed control member 196 be imparted to rotatable cam element 39 through control cable 45 extending therebetween which cable is tensioned by mechanical spring element 216 and by helically wound mechanical spring element 46 carried by the hub of rotary cam element 39 so as to implement the several stages or modes of operation of appliance 10 sequentially and maintain such stage or mode by registering the ball bearing 214 in the selected detent or recess establishing the mode.

According to the invention the cyclone separator 14 is assembled from a lower section 226 and an upper section 228 with the lower hollow generally cylindrically-shaped section 226 preferably transparent, and adapted for separation from upper section 228 and removal from applicance 10 for emptying the recovered spent particles of cleaning composition soil and debris.

Upright hollow support column formations 16, and 18, between which the cyclone separator is mounted, are extensible; each comprising a lower portion 16*a*, 18*a* respectively secured lowermost to the respective hollow pivot formations 20, 22 and into which aligned mating hollow extension portions 16*b*, 18*b* which depend from the upper mating section 228 of cyclone separator 14 telescope.

Upper telescoping sections 16*b*, 18*b* are adapted to be releasably secured to the lower sections 16*a*, 18*a* against separation by suitable latches 230*a* and 230*b* disposed outwardly of the respective upstanding hollow support formations 16, 18.

Figure 6:
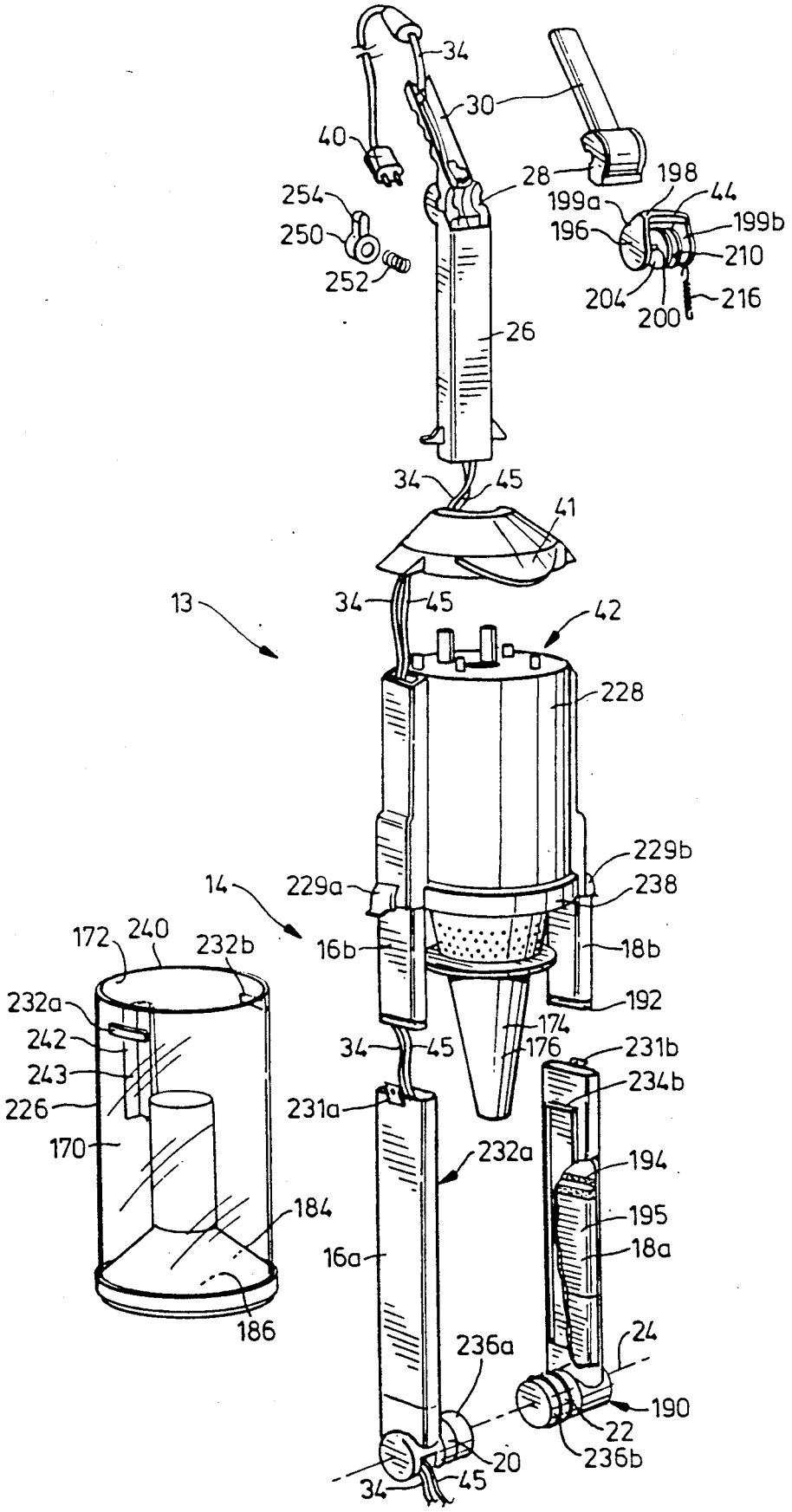
FIG. 6 is a partially exploded view in perspective of the components of the upright body portion of the apparatus of FIGS. 1 to 5 inclusive.

Lower cylindrically-shaped section 226 of cyclone separator 14 is adapted to be releaseably anchored between the spaced apart upstanding hollow support formations 16*a*, 18*a* through alignment and registration of respective interengageable ledge formations 232*a*, 232*b* and 234*a* and 234*b* carried by cylindrically-shaped lower section 226 and lower hollow extension portions 16*a*, 18*a* respectively as indicated in FIG. 6, which, when upper support columns 16*b*, 18*b* are fully registered within lower support columns 16*a*, 18*a*, retain such cylindrically-shaped lower section 226 centrally within lower hollow extension portions 16*a*, 18*a* against downward displacement and are so positioned that the lowermost extent of section 226 is supported above fixed pivot portions 236*a* and 236*b* of hollow pivot fomations 20, 22 mounted upon housing 32.

Upper casing portion 228 and associated depending hollow extensions 16*b*, 18*b* when released by latches 230*a*, 230*b* are displaceable upwardly together so as to break the seal between lower and upper sections 226, 228 and clear the upper edge 240 of lower section 226 whereby lower section 226 can be removed from between lower extensions 16*a*, 18*a* by disengaging ledge formations 232*a*, 232*b* and 234*a*, 234*b* and grasping the handle 242 to draw same therefrom.

When such lower section 226 is to be reinserted the respective ledge formations 232*a*, 232*b*, and 234*a*, 234*b* are reengaged and when fully registered upper section 228 displaced downwardly to fully register telescoping sections 16*b*, 18*b* within upstanding hollow sections 16*a*, 18*a* and fully seat the upper circumferential edge 240 of lower section 226 within the flange formation 238 against the seal so as to reestablish the cyclone separator 14 structure.

The respective sections 16*a*, 16*b*, 18*a*, 18*b* of hollow support formations 16, 18 are then secured together by latches 230*a*, 230*b* and which act to hold sections 226, 228 of the cyclone separator 14 against separation.

Latches 230*a*, 230*b* comprise outwardly and upwardly displaceable releasable clasp means 229*a*, 229*b* including inwardly disposed projections (not illustrated) which are attached to upper hollow support members 16*b*, 18*b*, respectively, and which are adapted to releasably clasp corresponding recess means 231*a*, 231*b*, located in respective lower hollow support formations 18*a*. To release the respective sections 16*a*, 16*b*, 18*a*, 18*b*, 20 of hollow support formations 16, 18, the operator grasps respective clasp means 229*a*, 229*b* and urges same outwardly releasing same from the respective recess means 231*a*, 231*b*. Pulling upwardly on clasp means 229*a*, 229*b* then releases depending hollow extensions 16*b*, 18*b*, from hollow extensions 16*a*, 18*a*, allowing the operator to displace upper casing portion 228 and associated depending hollow extension 16*b*, 18*b* upwardly so as to break the seal between lower and upper sections 226, 228 and clear the upper edge 240 of lower section 226 whereby the lower section 226 can be removed from between lower extensions 16*a*, 18*a* as hereinbefore described.

It can be appreciated that since hollow support member 18 is comprised of lower and upper sections 18*a*, 18*b*, respectively, that when dirty air passes through the hollow interior 195 of upstanding hollow support column 18, leakage of dirty air can occur through the juncture between the respective lower and upper members 18*a*, 18*b* when same are in sealing engagement.

In order to overcome this difficulty a displaceable seal 194 is provided to be slidably received within the hollow interior 195 of lower support column 18*a*. Displaceable seal 194 has an outer perimetral extent which matches the inner perimetral extent of column 18*a*. Further, upper hollow support column 18*b* is provided on its lower edge with a suitable seal 192. Therefore, when upper and lower sections 18*a*, 18*b* of hollow support formation 18 are engaged and secured together by latches 232*a*, 232*b*, and upon drawing dirty air into fan intake chamber 86 and then delivering same by impeller 88 to the hollow interior 195 of upstanding hollow support column 18 displaceable seal 194 is displaced upwardly by the dirty air through hollow support column 18*a* and brought into pressure sealing engagement with seal 192 of upper hollow support column 18*b*. This provides an effective seal preventing any egress of air from the juncture of upper and lower support columns 18*a*, 18*b*, respectively.

Dispensing and Brushing Mode of Operation

When appliance 10 is to be operated to dispense the "dry" particulate carpet cleaning powder to the carpet, broadloom, or rug to be cleaned, such appliance is first checked to make sure that same is turned "off" by grasping upstanding bar portion 198 of indexed rotary control element 196 of switching device 44 and rotating same to the "off" position indicated on the exterior of knuckle 28 immediately beneath portion 198 and held in such position by spring urged ball bearing 214 registering within the respective indent or recess 212 of disc-like member 210.

In particular, in the "off" mode cam follower 33 of electric switch 38 is displaced by camming surface 35 so as to depress displacable contact 37. Upon switching the appliance to either the "dispensing & brush", "brush", or "vacuum" only modes the camming surface 35 is rotated through rotary cam element 39 so that cam follower 33 is no longer displaced by camming surface 35 and no longer depresses contact 37. FIG. 10 illustrates the configuration of cam follower 33 and camming surface 35 when appliance 10 is switched to the "off" mode. It can be appreciated from this drawing that upon displacement of camming surface 35 of rotary cam element 39 in either direction cam follower 33 will no longer be displaced by camming surface 35 thereby releasing contact 37 to complete the "circuit" of electric switch 38 which in turn energizes electric motor 36.

With bar portion 198 of rotary control element 196 placed in the "off" mode electric cord and associated plug 40 is then inserted into an appropriate wall socket to provide the power to operate the appliance.

Electric cord 40 is stored on appliance 10 wound or looped around at the upper end thereof a quick release hook formation 250, located on the upper rear surface of shaft-like control member 26, and at the lower end thereof around handle 242, located on the rear surface of lower cyclone section 226. Particularly the electric cord is held within the space provided between projection 254 of quick release 250 and the rear surface of shaft-like control member 26, as best illustrated in FIG. 12, and the space provided between projection 243 of handle 242 and rear surface of lower cyclone section 226.

To release the wound electric cord and associated plug 40 from appliance 10 the operator rotates quick release 250 about pivot 252 so that projection 254 faces downwardly thereby presenting a smooth uninterrupted surface upwardly enabling the electric cord to be slid off quick release 250 freeing same at the upper end thereof for release from its wound stored position on appliance 10.

The height adjustment of the appliance is then set by adjusting indexed rotary control member 68 which engages one end of axle 64, carrying the wheels 62*a*, 62*b*, between successive graded tooth elements 69 to swing same through an arc against the action of associated helically wound spring (not illustrated) out of the retracted position and so selectively set and fix the downward descent of same.

When appliance 10 is to be operated to dispense and apply the "dry" carpet cleaning composition to the carpet, broadloom, or rug to be cleaned, such composition is deposited in the receptacle portion of hopper formation 144 by swinging shell-like cover 151 forwardly and upwardly about pivots 152*a*, 152*b* in the direction of arrow 155, as shown in FIG. 8, to provide access thereto. After hopper formation 144 is filled with the required amount of powder, cover 151 is then swung rearwardly until depending side wall portions 156*a* and 156*b* register within matching recesses 157*a* and 157*b* presented by the sector shaped sidewall portions 150*a*, 150*b* of enclosure 51 so as to closely confine the "dry" particular carpet cleaning composition therein.

Such particulate cleaning composition should be evenly distributed over the respective transversely extending plate-like element 140 of bottom wall formation 142 and associated rearwardly extending bottom wall portion 148.

Figure 2:
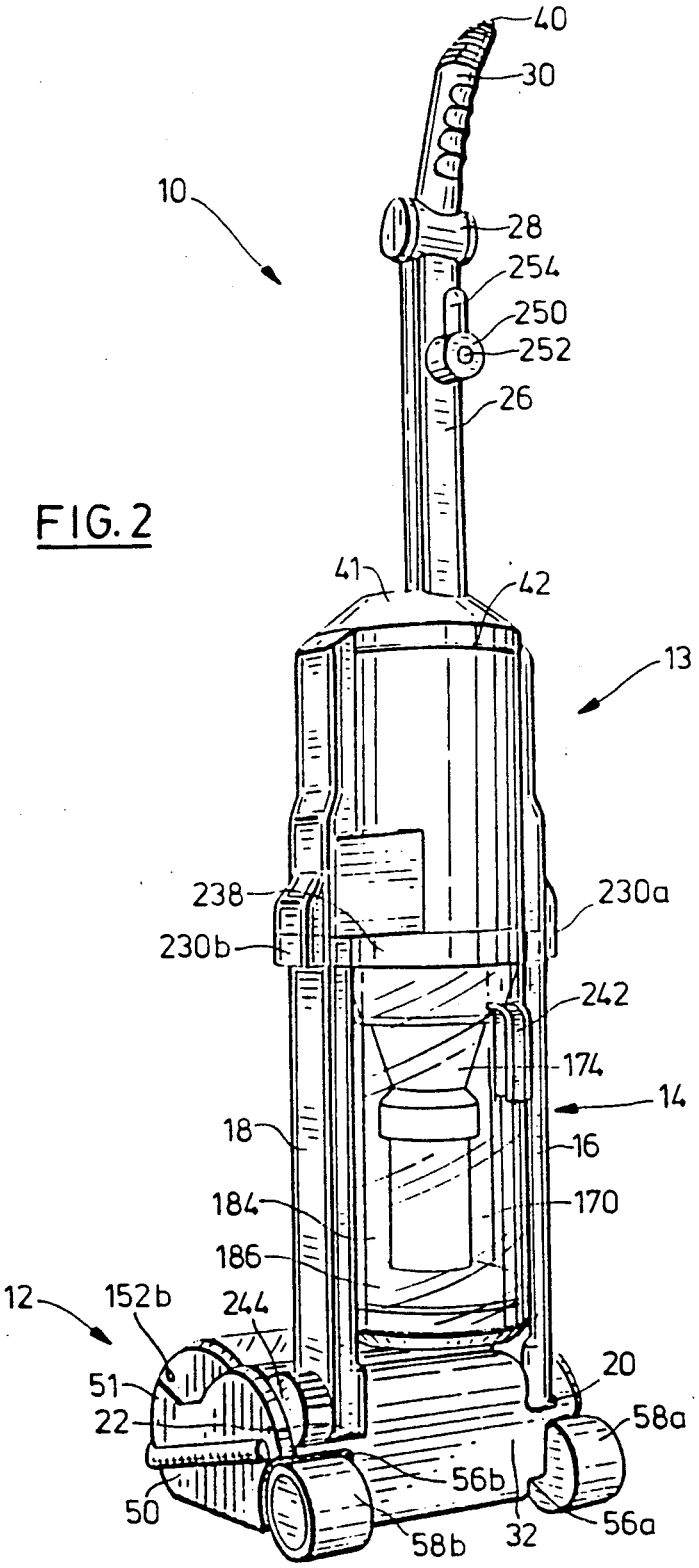
FIG. 2 is a perspective view taken from a point to the rear right side of the apparatus as illustrated in FIG. 1.
Figure 3:
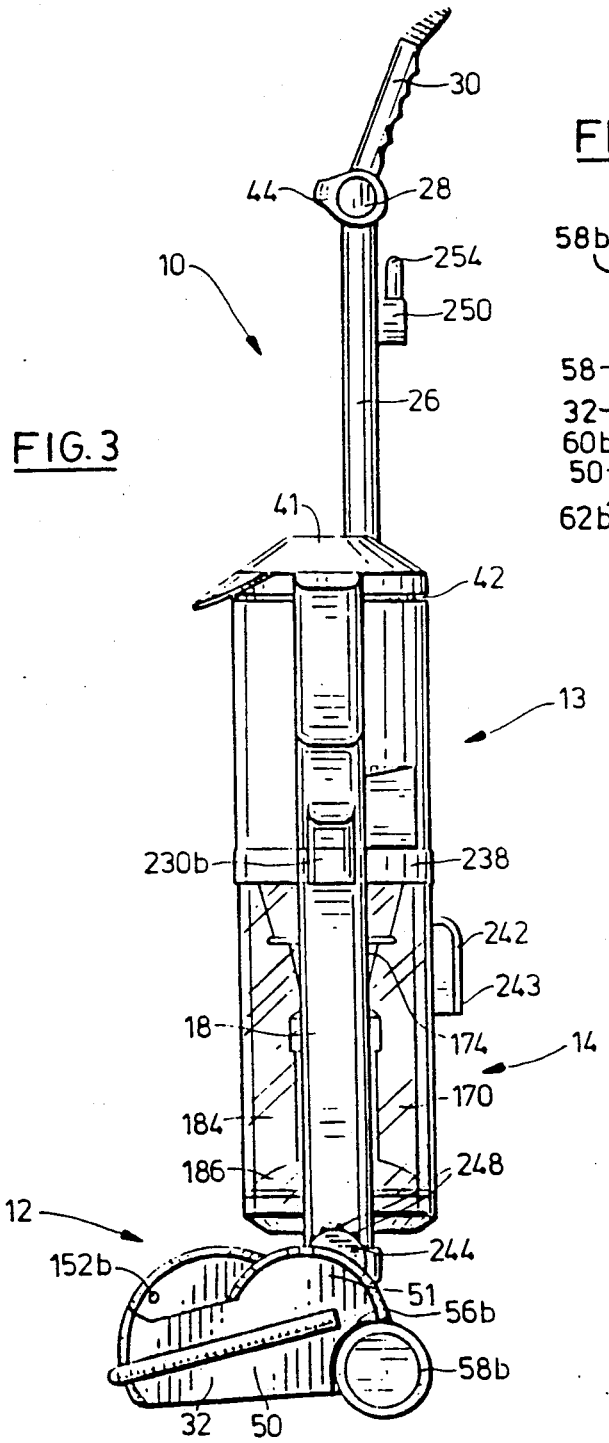
FIG. 3 is a side elevational view of the right side of the apparatus as illustrated in FIGS. 1 and 2.

Upstanding hollow support columns 16, 18 and associated cyclone separator 14, and control member 26 with hand-gripping extension 30 are released from the vertical disposition for storage shown in FIGS. 1 to 3 of the drawings by depressing a suitable spring-urged latching mechanism 244 so as to release same for swinging movement rearwardly downwardly throughout a range of inclined positions to accomodate the handling of the appliance 10 by the operator in the usual manner.

Spring urged latching mechanism 244 is best illustrated in FIGS. 5 and 7 and includes a spring 246 for urging latching mechanism 244 upwardly, and a projection 247, best illustrated in FIG. 5, for slidably engaging a respective slot (not illustrated) located in the outer surface of hollow pivot formation 22.

The operator, applies pressure to the upper toothed surface 248 of latching mechanism 244 and urges same downwardly against the action of spring 246 so as to disengage projection 247 from the respective slot located on hollow pivot formation 22 releasing upstanding hollow support columns 16, 18 and associated cyclone separator 14, and control member 26 with hand-gripping extension 30 from the vertical disposition rearwardly and downwardly to accomodate the handling of the appliance by operator.

Appliance 10 is then rolled onto the area of carpet to be treated with the rearwardly disposed wheels 58*a* and 58*b* and the forward pair of wheels 62*a* and 62*b* supporting the main body portion 12 thereof in selected spaced relation thereabove.

Having successfully adjusted the height of the vacuum appliance, and providing the required amount of "dry" cleaning composition to the hopper formation 144, and upon moving the machine to the appropriate area to be cleaned the appliance is then placed in the "dispense & brush" mode by rotating bar portion 198 of rotary control element 196 as illustrated in FIG. 12 from the "off" position upwardly to the uppermost position defined by spring urged ball bearing 214 registering within the respective indent or recess 212 and indicated by the appropriate markings on outer knuckle housing 28 of the mode: "dispense & brush."

Upon rotating bar portion 198 of rotary control element 196 upwardly to the "dispense & brush" mode uppermost the tension on cable portion 31 of control cable 45 is relaxed so that same is slidably displaced within outer sleeve 29 by its other end securely anchored within grooved end perimeter 224 on rotary cam element 39 by helically wound spring 46 mounted on hub portion 47 of the rotary cam element so that cam element 39 is rotated to the position illustrated in FIG. 9*c*. It can be appreciated upon viewing FIG. 10 that by displacing bar portion 198 of rotary control element 196 upwardly to the "dispense & brush" mode camming surface 35 moves to the right of the position shown in that figure by the displacement of rotatable cam element 39 by helical spring 46 so that cam follower 33 is no longer engaged by camming surface 35 thereby releasing contact 37 actuating electric switch 38 which actuates electric motor 36 for rotating impeller shaft 92 and motor shaft 94 which in turn rotates impeller 88 and brush or beater 78.

Looking at FIG. 9*c* it can be seen that sector gear 108 has not engaged sector gear 106 so as to pivot same about pivot 102 and displace valve plate 100. In the "dispense & brush" mode cam follower 114 of sector gear 106 is riding on the arcuate edge portion 164 of rotary cam element 39 and in such position remains rotated about pivot 102 so that valve plate 100 remains in the closed position illustrated in solid outline in FIG. 8. Further, mechanical spring 112 attached to the arm portion 110 of sector gear 106 provides additional pull to sector gear 106 about pivot 102 to further ensure valve plate 100 effectively seals internal passageway 82 leading from the inlet for nozzle 72 to the intake 86 of suction fan 74. With valve plate 100 in such position air is supplied to impeller 88 through the by-pass aperture 104.

Further, with rotary cam element 39 rotated to the position illustrated in FIG. 9*c* cam follower 162 of plate-like element 140 of bottom wall formation 142 follows the arcuate edge portion 164 of rotary cam element 39 and descends into recess portion 166 through the action of gravity, and, in the case of the embodiment illustrated in FIG. 9*d*, the pull of spring 147, whereupon plate-like element 140 is released to swing about hinge 149 downwardly to occupy the lower position shown in broken outline in FIG. 7 with lips 158, 160 separated: the gap between the lips 158, 160 in the preferred embodiment being of the order of 4 millimeters to constitute an effective discharge passageway for the particle sizes of the available carpet cleaning compositions to be dispensed from hopper formation 144.

As illustrated in FIG. 7, upon release and separation from upper lip 158 depending cam follower 138 of plate-like element 140 engages eccentric edge formation 136 presented by rotary cam element 134 which acts to periodically displace plate-like element 140 upwardly imparting reciprocatory movement thereto which agitates the "dry" carpet cleaning composition contained within hopper formation 144 and causes the particles to abrade and separate under the forces of gravity and those imparted by the upward displacement propelling same in a direction towards the discharge passageway 168 and through the gap established between lips 158, 160.

With such forces imparted to the advancing particles of the confined composition throughout the extent of plate-like element 140 of bottom wall portion 142 the particles are delivered continuously towards and through the full extent of the gap between lips 158, 160 for deposit onto the carpet surface therebelow through discharge passageway 168 located immediately ahead of rotary brush element of beater 78.

With the apparatus depositing evenly and continuously the "dry" powdered cleaning composition, apparatus 10 is moved backwards approximately a distance of three feet or one meter. An even layer of "dry" powdered cleaning composition is deposited to the carpeted surface to be cleaned.

After moving apparatus 10 backwards approximately three feet or one meter, the apparatus is slowly moved forwardly parallel to that portion of carpet that has just had its first layer of cleaning compound applied. During this forward movement the cleaning compound is deposited in the aforementioned manner and through bristles 76 of rotary brush or beater 78 worked into the fibres of the carpet. This back and forth motion is repeated until the entire surface to be cleaned has been covered.

After the entire surface area to be cleaned has been covered with the "dry" powdered cleaning composition the operator rotates bar portion 198 of rotary control element 196 of switching device 44 to the "brush" only mode. Once the appliance has been switched to the "brush" only mode the carpeted area where the cleaning compound was dispensed by backwards strokes but not brushed in is then gone over working into the fibres of the carpet the "dry" powder cleaning composition.

The entire area of the carpeted surface to be cleaned can then be gone over by the appliance in the "brush" only mode and further work the "dry" powdered cleaning composition into the fibres of the carpet.

By pushing bar portion 198 of rotary control element 196 downwardly to the next position above the "off" position defined by spring urged ball bearing 214 in recess or detent 212 of disc-shaped formation 210 and indicated on knuckle formation 28 to be the "brush" only mode, cable portion 31 is slidably displaced within outer sleeve 29 so as to rotate rotary cam element 39 against the action of helically wound spring 46 to the position illustrated in FIG. 9*b*.

The rotation of rotary cam element 39 moves cam follower 162 of plate-like element 140 out of recess 166 and onto the arcuate edge portion 164 of rotary cam element 39 displacing upwardly plate-like element 140 of bottom wall formation 142 and sealingly engaging lower lip 160 with upper lip 158. In such a position no "dry" powder cleaning composition can escape and exit through discharge passageway 168.

Further, the rotation imparted to rotary cam element 39 upon rotating rotary control element 196 to the "brush" only mode, is insufficient to engaged sector gear 106 with sector gear 108 and hence sector gear 106 maintains its position keeping valve plate 100 closed as described and illustrated in FIG. 9*c*for the "dispense & brush" mode.

Vacuum Mode of Operation:

When the powdered residue and associated carpet soil and accumulations are to be removed, the switching device is actuated to implement the third mode wherein plate valve 100 is displaced in the direction to establish communication between nozzle formation 72 and the intake 86 of blower of suction fan 74 through internal passageway 82 so that the airstream generated by the suction of the blower or fan 74 flowing in through the inlet orifice 70 and through nozzle formation 72 and rotating brush element or beater 78 entrains the powdered residues, carpet soil, and accumulations loosened by the brush fibres or bristles 76 and are ultimately directed, as earlier outlined, into the hollow passageway within upright support member 18 and into the dirty air inlet of the outer cyclone 170 of separator 14.

In the "vacuum" mode of operation bar portion 198 of rotary control element 196 is displaced downwardly through the "off" position and into the "vacuum" mode therebelow so indicated on knuckle 28 and defined by the positioning of spring urged ball bearing 214 within recess or detent 212 of disc-shaped formation 210.

Downward displacement of bar portion 198 of rotary control element 196 through control cable 45 rotates rotary control element 39 further against the action of helically wound spring 46 to the position illustrated in FIG. 9*a* for the "vacuum" mode. As seen in FIG. 9*a* cam follower 162 of plate-like element 140 continues to engage the arcuate edge portion 164 of rotary cam element 39 in a similar manner as described and illustrated for the "brush" only mode in FIG. 9*b*.

In the "vacuum" only mode, sector gear 108 is rotated upon rotation of rotary cam element 39 to engage sector gear 106 and rotate same about pivot 102 to swing sector gear 106 and associated valve plate 100 in a direction to close by-pass apperture 104, shown in broken outline in FIG. 8, and so retain same in such position to establish communication between the nozzle 72 and the fan intake 86 while operating in the "vacuum" mode.

Upon rotation of sector gear 106 by sector gear 108 upon rotation of rotary cam element 39 cam follower 114 of sector gear 106 upon following arcuate edge portion 164 of rotary cam element 39 descends into recess 116.

The dirty airstream drawn into the fan intake 86 is then delivered by impeller 88 into passageway 190 extending within hollow pivot formation 22 mounted upon the main lower body portion 12 and through the hollow interior 195 of upstanding hollow support column 18. Internal passageway 195 delivers the dirty airstream through the scroll shaped inlet to the outer cyclone 170 of cyclone separator 14 where the airstream is stripped of the large intake particles and debris which descend into the collection receptacle portion 184 lowermost thereof.

The stripped dirty airstream is then discharged through the outlet of the outer cyclone 170 into the scroll shaped inlet of inner cyclone 174 wherein the finer particles entrained therein are substantially completely stripped therefrom and descend to the lowermost receptacle portion 186 thereof. The resultant clean airstream substantially stripped of entrained particles is then directed upwardly centrally of the inner cyclone 174 and discharged through outlet 42 under cap formation 41 spaced thereabove and diverted radially thereby to the atmosphere.

Once the entire carpet to which the "dry" powdered cleaning composition has been added has been vacuumed bar portion 198 of rotary control element 196 is moved upwardly to the "off" position wherein rotary cam element 39 under the action of helically wound spring 46 rotates to the position illustrated in FIG. 10 wherein camming surface 35 of rotary control element 39 depresses cam follower 33 of electric switch 38 depressing button 37 and discontinuing the power to electric motor 36.

After appliance 10 has been switched "off" the operator separates lower section 226 from upper section 228 for emptying the recovered intake particles, soil, and debris, by grasping respective clasp means 229*a*, 229*b* and urging same outwardly to release the respective recess means 231*a*, 231*b*. Pulling upwardly on clasp means 229*a*, 229*b* releases depending hollow extensions 16*b*, 18*b*, from hollow extensions 16*a*, 18*a*, respectively, allowing the operator to displace upper casing portion 228 and associated depending hollow extensions 16*b*, 18*b* upwardly so as to break the seal between lower and upper sections 226, 228, and clear the upper edge 240 of lower section 226 whereby the lower section 226 can be removed from between lower extensions 16*a*, 18*a* by grasping handle 242 and removing same for emptying of the entrained particles and debris.

After the respective outer and inner receptacle portions 184, 186 are emptied of debris and other entrapped particles lower section 226 is reinserted by aligning respective edge formations 232*a*, 232*b*, and 234*a*, 234*b* and upon full registeration of same upper section 228 is displaced downwardly to fully register telescoping sections 16*b*, 18*b* within upstanding hollow sections 16*a*, 18*a* and fully seat the upper edge 240 of lower section 226 within flange formation 238 and so re-establish the cyclone separator 14 structure.

The electric cord and associated plug 40 is then disconnected from the power outlet and wound about respective handle 242 and quick release 250: quick release 250 is rotated about pivot 252 upwardly to secure the electric cord therewithin.

It will be understood that variations or alterations may by undertaken by those persons skilled in the art in respect of the method and apparatus described and illustrated herein without departing from the spirit and scope of the invention as set forth in the claims appended hereto.

What I claim is:

1. A dispensing apparatus comprising:

a hopper formation including forward, rearward, side and bottom wall portions wherein the lowermost section of the forward wall portion terminates in a generally horizontally extending edge formation and the bottom wall portion presents a like horizontally extending edge formation so as to define a discharge orifice formation between said edge formations;

means supporting said bottom wall portion for swinging movement downwardly to move said edge formations towards and away from one another;

means for imparting reciprocatory movement to said swingable bottom wall portion;

a rotary brush formation mounted for rotation in spaced relation below and rearward of said edge formations on an axis parallel to said edge formations; and means for imparting rotation to said rotary brush formation while reciprocatory movement is imparted to said swingable bottom wall portion.

2. A dispensing apparatus according to claim 1 wherein said swingable bottom wall portion inclines upwardly from said edge formations to the rear.

3. A dispensing apparatus according to claim 2, wherein means are provided for supporting said forward wall portion for swinging movement towards and away from said bottom wall portion so as to provide access to said hopper formation from above.

4. A dispensing apparatus according to claim 3 wherein the upper surface of said swingable bottom wall portion is substantially flat and smooth.

5. A dispensing apparatus according to claim 4 wherein releasable means are provided for maintaining said edge formations in engagement.

6. An apparatus for controlling the dispensing of a particulate composition onto an underlying surface comprising:

a receptacle portion having front, side and rear wall formations upstanding from a bottom wall formation including a displaceable pathway portion partially defining a discharge orifice formation for the passage of the particulate composition therethrough;

means supporting said receptacle portion for travel over the underlying surface and so present said discharge orifice formation to extend across the path of travel; and means carried by said support means for imparting reciprocatory movement to said displaceable pathway portion.

7. A carpet cleaning apparatus comprising:

a hopper formation for the dispensing a particulate cleaning composition onto an underlying surface;

a rotary brush for working such composition on the underlying surface;

said hopper formation including a receptacle portion having front, side and rear wall formations upstanding from a bottom wall formation including a displaceable pathway portion partially defining a discharge orifice formation for the passage of the particulate composition therethrough;

means supporting said receptacle portion for travel over the underlying surface to be treated and so present said discharge orifice formation to extend across the path of travel;

said rotary brush being mounted for rotation within said support means so as to contact the underlying surface and extend across the path of travel; and means carried by said support means for imparting reciprocatory movement to said displaceable pathway portion and for rotating said rotary brush.

8. A carpet cleaning apparatus comprising:

a hopper formation for dispensing of a particulate cleaning composition onto an underlying surface;

a rotary brush for working such composition into the fibres of the surface;

a rotary suction fan, a collection means for collecting residues of such composition and a nozzle communicating with the rotary suction fan and the associated collection means for recovering and collecting residues of such composition from the surface;

said hopper formation including a receptacle portion having front, side and rear wall formations upstanding from a bottom wall formation including a displaceable pathway portion partially defining a discharge orifice formation for the passage of the particulate composition therethrough;

means supporting said receptacle portion for travel over the underlying surface and so present said discharge orifice formation to extend across the path of travel;

said rotary brush being mounted for rotation within said support means so as to be presented to the underlying surface and extend across the path of travel;

said nozzle mounted on said support means to embrace said rotary brush and communicate with said rotary suction fan and associated collection means through a conduit extending between said fan and collection means; and means carried by said support means for imparting reciprocatory movement to said displaceable pathway portion and for rotating said rotary brush and rotary suction fan.

9. Apparatus according to claim 8, wherein said discharge orifice formation is defined by a pair of opposed orifice defining lips wherein one of said lips comprises said displaceable pathway portion for reciprocatory movement therewith towards and away from the other lip so as to define a discharge gap therebetween, throughout such movement, through which the particulate composition may pass.

10. Apparatus according to claim 9 wherein the other of said opposed lips is presented by a portion of said front wall formation of said receptacle portion.

11. Apparatus according to claim 10 wherein said other orifice defining lip comprises a portion of said front wall formation extending inwardly from said front wall formation.

12. Apparatus according to claim 11 wherein said displaceable pathway portion is downwardly inclined towards said discharge orifice formation.

13. Apparatus according to claim 12 wherein said orifice defining lips have a maximum extent corresponding to the separation between the upstanding side wall formations of said receptacle portion.

14. Apparatus according to claim 13 wherein said orifice defining lips extend generally linearly horizontally.

15. Apparatus according to claim 14 wherein said displaceable pathway portion is mounted to swing from below upwardly whereby the lip thereof abuts the other of said lips and to swing downwardly under said reciprocatory movement.

16. Apparatus according to claim 15 wherein said means for imparting reciprocatory movement to said displaceable pathway portion include a rotary cam and a first cam follower.

17. Apparatus according to claim 16 wherein said first cam follower is carried by said displaceable pathway portion.

18. Apparatus according to claim 16 wherein said first cam follower depends from said displaceable pathway portion and said rotary cam presents a peripheral camming surface to said first cam follower in juxtaposition thereto, both the first cam follower and rotary cam being of a configuration whereby under rotation of said rotary cam the displaceable pathway portion is periodically reciprocated upwardly.

19. Apparatus according to claim 18 wherein said displaceable pathway portion is biased so that said first cam follower bears against said peripheral camming surface of said rotary cam.

20. Apparatus according to claim 19 wherein said displaceable pathway portion is biased by means of a spring.

21. Apparatus according to claim 16 wherein releasable means are provided for displacing the orifice defining lip of said pathway portion in a direction to bring the orifice defining lip together with the other of said orifice defining lips so as to close the discharge gap and hold the pathway portion against reciprocatory movement.

22. Apparatus according to claim 21 wherein said releasable means includes a second cam follower and a rotatable cam.

23. Apparatus according to claim 22 wherein said second cam follower depends from said displaceable pathway portion and said rotatable cam presents a partial camming surface to the second cam follower in juxtaposition thereto, both the second cam follower and rotary cam being of a configuration whereby, under partial rotation of said rotatable cam in one direction, said pathway portion is displaced upwardly to bring the orifice defining lip of the displaceable pathway portion together with the other of said orifice defining lips so as to close the discharge gap and hold same against reciprocatory movement and under partial rotation of said rotatable cam means in the reverse direction to release said pathway portion for reciprocatory movement.

24. Apparatus according to claim 22 wherein said displaceable pathway portion is biased against said means for imparting reciprocatory movement.

25. Apparatus according to claim 24 wherein said displaceable pathway portion is biased by means of a spring against said means for imparting reciprocatory movement.

26. Apparatus according to claim 25 wherein said spring is secured at one end to said second cam follower of said releasable means and secured at its other end to said bottom wall formation.

27. Apparatus according to claim 11 wherein said displaceable pathway portion is downwardly inclined at an angle of the order of 15° to the horizontal when the lip formation thereof abuts the other of said lips defining said orifice.

28. A carpet cleaning apparatus comprising: a base and wheels for supporting the apparatus for travel, a swingable handle formation projecting upwardly from said base for directing said base along a path of travel, a rotary brush mounted for rotation within said base to extend transversely of the path of travel of said base and project therebelow, a hopper formation mounted upon said base for receiving a particulate cleaning composition to be dispensed, a receptacle portion having front, side and rear wall formations upstanding from a bottom wall formation, a displaceable pathway portion partially defining a discharge orifice formation for the passage of the particulate composition therethrough, the discharge orifice formation being responsive to the displacement of said pathway portion and being arranged so as to extend transversely of the path of travel of said base and deliver the dispensed particulate composition therebeyond, means carried by said base for imparting reciprocatory movement to said displaceable pathway portion and for rotating said rotary brush, and switch means for controlling the imparting of said reciprocatory movement to said displaceable pathway portion and the imparting of rotation to said rotary brush.

29. Apparatus according to claim 28 wherein a nozzle has an inlet and outlet, and is carried by said base so as to embrace said rotary brush, with the inlet of the nozzle registering with that portion of said rotary brush projecting below said base, and which apparatus further includes a conduit leading from the outlet of said nozzle to a suction fan and further leading to an associated collection means, said suction fan generating an airstream from the inlet of said nozzle to said suction fan and said collection means whereby residues loosened by said rotary brush are recovered in said collection means and the airstream vented to the atmosphere.

30. Apparatus according to claim 29 wherein said suction fan is carried by said base.

31. Apparatus according to claim 30 wherein said associated collection means is carried by said swingable handle formation.

32. Apparatus according to claim 29 wherein said collection means comprises a cyclone separator.

33. Apparatus according to claim 29 wherein said swingable handle formation comprises a lower section including spaced apart supports and an upper section terminating uppermost in a hand-gripping portion.

34. Apparatus according to claim 33 wherein one of said supports includes a segment of said conduit leading from said suction fan to said collection means.

35. Apparatus according to claim 34 wherein said collection means comprises a cyclone separator having an inlet and an outlet with said cyclone separator mounted between said spaced apart supports, and means for establishing communication between said inlet of said cyclone separator and said segment of said conduit included within one of said supports.

36. Apparatus according to claim 35 wherein said cyclone separator comprises an interengaged upper section and lower section, with said upper section longitudinally separable from engagement with said lower section for removal of said lower section from the apparatus.

37. Apparatus according to claim 36 wherein said spaced apart supports are each comprised of upper and lower telescoping members, with said upper telescoping members being upwardly separable from said lower telescoping members and carrying said upper section of said cyclone separator therebetween, whereby, upon upward displacement of said upper telescoping members, said upper section of said cyclone separator is sufficiently longitudinally separated from said lower section of said cyclone separator so as to disengage from said lower section of the cyclone separator.

38. Apparatus according to claim 37 wherein said lower section of said cyclone separator is releasably secured against separation from the lower telescoping members of said spaced apart supports.

39. Apparatus according to claim 37 wherein said upper and lower telescoping members of said spaced apart supports are releasably secured against separation by suitable latches when said upper and lower sections of said cyclone separator are interengaged.

40. Apparatus according to claim 29 wherein that portion of said conduit leading from said outlet of said nozzle to said suction fan includes a valve therein, said valve being displaceable between a first position and a second position, said valve in said first position blocking said conduit so as to isolate said nozzle from said suction fan when said displaceable pathway portion is released for reciprocatory movement, and said valve in said second position establishing communication between said nozzle and said suction fan when said displaceable pathway portion is held against reciprocatory movement.

41. Apparatus according to claim 40 wherein said valve comprises a plate member carried by a pivot formation, and means are carried by said pivot formation for imparting displacement to the plate member.

42. Apparatus according to claim 41 wherein said means for imparting displacement to said pivot formation include a sector gear.

43. Apparatus according to claim 42 wherein said means for imparting reciprocatory movement to said displaceable pathway portion include a rotary cam and a first cam follower.

44. Apparatus according to claim 43 wherein a rotatable cam associated with a releasable means for displacing said pathway portion presents a further sector gear for interengagement with said sector gear of said pivot formation carried by said plate member whereby, under partial rotation of said rotatable cam in one direction, said valve is displaced to a first position blocking said conduit so as to isolate said nozzle from said suction fan, and, under partial rotation of said rotatable cam in another direction, said valve is displaced to said second position establishing communication between said nozzle and said suction fan.

45. Apparatus according to claim 44 wherein said means for imparting displacement to said pivot formation is spring biased to urge said plate member into said first position blocking said conduit.

46. Apparatus according to claim 45 wherein said apparatus is provided with actuating means for rotating said rotatable cam.

47. Apparatus according to claim 42 wherein the means for imparting displacement to said pivot formation carried by said valve plate member includes a third cam follower.

48. Apparatus according to claim 28 wherein said apparatus is provided with actuating means for rotating a rotatable cam.

49. Apparatus according to claim 48 wherein said actuating means is connected to said rotatable cam through a displaceable cable.

50. Apparatus according to claim 49 wherein said actuating means is rotatable about an axis to displace said cable.

51. Apparatus according to claim 50 wherein said actuating means is carried by said swingable handle formation.

52. Apparatus according to claim 49 wherein said rotatable cam is spring biased to impart tension to said cable.

53. Apparatus according to claim 28, wherein a switch means is provided for controlling the imparting of reciprocatory movement to said displaceable pathway portion and rotation to said rotary brush.

54. Apparatus according to claim 28 wherein said discharge orifice formation is defined by a pair of opposed orifice defining lips wherein one of said lips comprises said displaceable pathway portion for reciprocatory movement therewith towards and away from the other lip so as to define a discharge gap therebetween, throughout such movement, through which the particulate composition may pass.

55. Apparatus according to claim 54 wherein releasable means are provided for displacing the orifice defining lip of said pathway portion in a direction to bring the orifice defining lip together with the other of said orifice defining lips so as to close the discharge gap and hold the pathway portion against reciprocatory movement.

56. Apparatus according to claim 55 wherein said releasable means includes a second cam follower and a rotatable cam.

57. Apparatus according to claim 56 wherein said second cam follower depends from said displaceable pathway portion and said rotatable cam presents a part peripheral camming surface to the second cam follower in juxtaposition thereto, both the second cam follower and rotary cam being of a configuration whereby, under partial rotation of said rotatable cam in one direction, said pathway portion is displaced upwardly to bring the orifice defining lip of the displaceable pathway portion together with the other of said orifice defining lips so as to close the discharge gap and hold same against reciprocatory movement and under partial rotation of said rotatable cam means in the reverse direction to release said pathway portion for reciprocatory movement.

58. Apparatus according to claim 56 wherein said displaceable pathway portion is biased by means of a spring against said means for imparting reciprocatory movement thereto.

59. Apparatus according to claim 50 wherein said spring is secured at one end to said second cam follower and secured at its other end to said bottom wall formation.

60. Apparatus according to claim 28 wherein said displaceable pathway portion is biased against said means for imparting reciprocatory movement to said displaceable pathway portion.

* * * * *

UNITED STATES PATENT AND TRADEMARK OFFICE

CERTIFICATE OF CORRECTION

PATENT NO. : 5,101,532

DATED : April 7, 1992

INVENTOR(S) : Dyson et al.

It is certified that error appears in the above-identified patent and that said Letters Patent is hereby corrected as shown below:

On the Title page, item [75], please delete "Donald J. LaButte" as a named inventor.

At column 28, line 52, add

-- 61. A dispensing apparatus according to claim 1 wherein said swingable bottom wall portion is biased against said means for imparting reciprocatory movement. --

At column 28, line 44, delete "50" and substitute -- 58 --.

Substitute the entire Abstract with the following text:

-- Apparatus controlling the dispensing of "dry" powdered compositions, particularly carpet cleaning compositions consisting of confined finely divided particles which descend in a stream under gravity and have oscillatory movement imparted thereto before being discharged through an orifice leading from the apparatus so as to agitate, separate and propel the particles through said orifice. In the case of carpet cleaning operations the finely divided discharged particles are deposited onto a surface with fibres in a substantially uniform pattern followed by working the discharged particles into the fibres through the application to the surface of a rotary brush or beater and thereafter

UNITED STATES PATENT AND TRADEMARK OFFICE

CERTIFICATE OF CORRECTION

PATENT NO. : 5,101,532

DATED : April 7, 1992

INVENTOR(S) : Dyson et al.

It is certified that error appears in the above-identified patent and that said Letters Patent is hereby corrected as shown below:

recovering residues by a suitable suction or vacuum unit utilizing a rotary brush or beater and an associated two stage cyclone separator. --

Signed and Sealed this

Twelfth Day of October, 1993

Bruce Lehman

*Attest:*

BRUCE LEHMAN

*Attesting Officer*

*Commissioner of Patents and Trademarks*